US008588670B2

(12) United States Patent
Shimokawa et al.

(10) Patent No.: US 8,588,670 B2
(45) Date of Patent: Nov. 19, 2013

(54) FIXING DEVICE HAVING A REFLECTOR AND IMAGE FORMING APPARATUS INCORPORATING SAME

(75) Inventors: Toshihiko Shimokawa, Kanegawa (JP); Masaaki Yoshikawa, Tokyo (JP); Kenji Ishii, Kanagawa (JP); Naoki Iwaya, Tokyo (JP); Tetsuo Tokuda, Kanagawa (JP); Yoshiki Yamaguchi, Kanagawa (JP); Yutaka Ikebuchi, Kanagawa (JP); Takamasa Hase, Kanagawa (JP); Takahiro Imada, Kanagawa (JP); Akira Shinshi, Tokyo (JP); Kenichi Hasegawa, Kanagawa (JP); Hiroshi Yoshinaga, Chiba (JP); Ippei Fujimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 265 days.

(21) Appl. No.: 13/097,711

(22) Filed: Apr. 29, 2011

(65) Prior Publication Data

US 2011/0274453 A1 Nov. 10, 2011

(30) Foreign Application Priority Data

May 7, 2010 (JP) ..... 2010-106884

(51) Int. Cl.
*G03G 15/20* (2006.01)

(52) U.S. Cl.
USPC ..... 399/334; 399/45; 399/329

(58) Field of Classification Search
USPC ..... 399/328, 329, 334
See application file for complete search history.

(56) References Cited

U.S. PATENT DOCUMENTS

| | | | |
|---|---|---|---|
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,840,151 | B2 | 11/2010 | Fujimoto |

(Continued)

FOREIGN PATENT DOCUMENTS

| | | | |
|---|---|---|---|
| JP | 2884714 | | 2/1999 |
| JP | 2006337539 | A * | 12/2006 |

(Continued)

OTHER PUBLICATIONS

U.S. Appl. No. 12/946,276, filed Nov. 15, 2010, Masaaki Yoshikawa, et al.

(Continued)

*Primary Examiner* — Walter L Lindsay, Jr.
*Assistant Examiner* — Milton Gonzalez
(74) *Attorney, Agent, or Firm* — Oblon, Spivak, McClelland, Maier & Neustadt, L.L.P.

(57) ABSTRACT

A fixing device includes a metal thermal conductor provided inside a loop formed by a fixing rotary body to heat the fixing rotary body; a heater provided inside the metal thermal conductor to heat the metal thermal conductor; a pad support provided inside the metal thermal conductor; and a reflector provided between the heater and the pad support to reflect heat emitted by the heater thereto toward an inner circumferential surface of the metal thermal conductor. The reflector includes a center reflection portion provided at a center of the reflector in a longitudinal direction thereof and a plurality of end reflection portions provided at respective lateral ends of the reflector. A plurality of reflector moving assemblies is connected to the plurality of end reflection portions of the reflector, respectively, to tilt the plurality of end reflection portions toward the center reflection portion.

8 Claims, 8 Drawing Sheets

(56) References Cited

U.S. PATENT DOCUMENTS

| | | | |
|---|---|---|---|
| 7,869,753 | B2 | 1/2011 | Shinshi |
| 7,899,350 | B2 | 3/2011 | Shinshi |
| 7,912,392 | B2 | 3/2011 | Yoshinaga et al. |
| 2007/0292175 | A1 | 12/2007 | Shinshi |
| 2008/0112739 | A1 | 5/2008 | Shinshi |
| 2008/0175633 | A1 | 7/2008 | Shinshi |
| 2008/0219730 | A1 | 9/2008 | Shinshi |
| 2008/0298862 | A1 | 12/2008 | Shinshi |
| 2008/0317532 | A1 | 12/2008 | Ehara et al. |
| 2009/0067902 | A1 | 3/2009 | Yoshinaga et al. |
| 2009/0123201 | A1 | 5/2009 | Ehara et al. |
| 2009/0123202 | A1 | 5/2009 | Yoshinaga et al. |
| 2009/0148204 | A1 | 6/2009 | Yoshinaga et al. |
| 2009/0148205 | A1 | 6/2009 | Seo et al. |
| 2009/0245865 | A1 | 10/2009 | Shinshi et al. |
| 2009/0245897 | A1 | 10/2009 | Seo et al. |
| 2009/0297197 | A1 | 12/2009 | Hase |
| 2009/0311016 | A1 | 12/2009 | Shinshi |
| 2010/0061753 | A1 | 3/2010 | Hase |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2010/0303521 | A1 | 12/2010 | Ogawa et al. |
| 2011/0013950 | A1 | 1/2011 | Furuya et al. |
| 2011/0026987 | A1 | 2/2011 | Hasegawa |
| 2011/0026988 | A1 | 2/2011 | Yoshikawa et al. |
| 2011/0044706 | A1 | 2/2011 | Iwaya et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052277 | A1 | 3/2011 | Ueno et al. |
| 2011/0052282 | A1 | 3/2011 | Shinshi et al. |
| 2011/0058832 | A1 | 3/2011 | Suzuki et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064450 | A1 | 3/2011 | Ishii et al. |
| 2011/0064451 | A1 | 3/2011 | Yamaguchi et al. |
| 2011/0064490 | A1 | 3/2011 | Imada et al. |
| 2011/0064502 | A1 | 3/2011 | Hase et al. |
| 2011/0070003 | A1 | 3/2011 | Shinshi |
| 2011/0076071 | A1 | 3/2011 | Yamaguchi et al. |
| 2011/0085832 | A1 | 4/2011 | Hasegawa et al. |

FOREIGN PATENT DOCUMENTS

| | | | |
|---|---|---|---|
| JP | 2008-158482 | | 7/2008 |
| JP | 2008298824 | A * | 12/2008 |
| JP | 2009-3410 | | 1/2009 |
| JP | 2009216783 | A * | 9/2009 |

OTHER PUBLICATIONS

U.S. Appl. No. 12/946,347, filed Nov. 15, 2010, Kenji Ishii, et al.
U.S. Appl. No. 13/026,945, filed Feb. 14, 2011, Kenji Ishii, et al.
U.S. Appl. No. 12/929,325, filed Jan. 14, 2011.
U.S. Appl. No. 13/048,160, filed Mar. 15, 2011, Yoshiki Yamaguchi, et al.
U.S. Appl. No. 12/985,637, filed Jan. 6, 2011, Takamasa Hase.
U.S. Appl. No. 12/926,661, filed Dec. 2, 2010.
U.S. Appl. No. 12/964,090, filed Dec. 9, 2010, Naoki Iwaya, et al.
U.S. Appl. No. 13/041,703, filed Mar. 7, 2011, Tadashi Ogawa, et al.
U.S. Appl. No. 13/064,201, filed Mar. 10, 2011.
U.S. Appl. No. 13/064,137, filed Mar. 8, 2011.
U.S. Appl. No. 13/014,306, filed Jan. 26, 2011, Kenji Ishii, et al.
U.S. Appl. No. 13/027,533, filed Feb. 15, 2011, Hiroshi Yoshinaga, et al.
U.S. Appl. No. 13/064,105, filed Mar. 7, 2011.
U.S. Appl. No. 12/974,852, filed Dec. 21, 2010, Takamasa Hase, et al.
U.S. Appl. No. 12/929,563, filed Feb. 1, 2011.
U.S. Appl. No. 12/929,961, filed Feb. 28, 2011.
U.S. Appl. No. 13/049,330, filed Mar. 16, 2011, Satoshi Ueno, et al.
U.S. Appl. No. 13/024,736, filed Feb. 10, 2011, Kenji Ishii, et al.
U.S. Appl. No. 13/027,595, filed Feb. 15, 2011, Ippei Fujimoto, et al.
U.S. Appl. No. 13/029,794, filed Feb. 17, 2011, Akira Shinshi, et al.
U.S. Appl. No. 13/048,167, filed Mar. 15, 2011, Takahiro Imada, et al.
U.S. Appl. No. 13/045,182, filed Mar. 10, 2011, Masaaki Yoshikawa, et al.
U.S. Appl. No. 13/020,231, filed Feb. 3, 2011, Kenichi Hasegawa.
U.S. Appl. No. 12/959,705, filed Dec. 3, 2010, Kenichi Hasegawa, et al.
U.S. Appl. No. 12/929,626, filed Feb. 4, 2011.
U.S. Appl. No. 13/016,342, filed Jan. 28, 2011, Tetsuo Tokuda, et al.
U.S. Appl. No. 13/009,199, filed Jan. 19, 2011, Masaaki Yoshikawa, et al.
U.S. Appl. No. 13/020,289, filed Feb. 3, 2011, Takamasa Hase, et al.
U.S. Appl. No. 12/963,120, filed Dec. 8, 2010, Akira Shinshi.
U.S. Appl. No. 13/045,715, filed Mar. 11, 2011, Kenichi Hasegawa.
U.S. Appl. No. 12/929,496, filed Jan. 28, 2011.
U.S. Appl. No. 12/986,425, filed Jan. 7, 2011, Takashi Seto, et al.
U.S. Appl. No. 12/923,985, filed Mar. 7, 2011.
U.S. Appl. No. 13/044,970, filed Mar. 10, 2011, Masaaki Yoshikawa, et al.
U.S. Appl. No. 13/028,597, filed Feb. 16, 2011, Kenji Ishii, et al.
U.S. Appl. No. 12/929,930, filed Feb. 25, 2011.
U.S. Appl. No. 13/041,729, filed Mar. 7, 2011, Naoki Iwaya, et al.
U.S. Appl. No. 13/042,706, filed Mar. 8, 2011, Tetsuo Tokuda, et al.
U.S. Appl. No. 12/929,915, filed Feb. 24, 2011.

* cited by examiner

FIXING DEVICE HAVING A REFLECTOR AND IMAGE FORMING APPARATUS INCORPORATING SAME

CROSS-REFERENCE TO RELATED APPLICATIONS

The present application is based on and claims priority to Japanese Patent Application No. 2010-106884, filed on May 7, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing belt, formed into a loop, to apply heat to the recording medium bearing the toner image, and a pressing roller, disposed opposite the fixing belt, to apply pressure to the recording medium. A stationary, nip formation pad disposed inside the loop formed by the fixing belt is pressed against the pressing roller disposed outside the loop formed by the fixing belt via the fixing belt to form a nip between the fixing belt and the pressing roller through which the recording medium bearing the toner image passes. As the fixing belt and the pressing roller rotate and convey the recording medium through the nip, they apply heat and pressure to the recording medium to fix the toner image on the recording medium.

As a mechanism that heats the fixing belt, the fixing device may include a substantially tubular metal member disposed inside the loop formed by the fixing belt and a heater disposed inside the metal member to heat the metal member, which in turn heats the fixing belt. In addition, the nip formation pad pressed against the pressing roller may be supported by a pad support disposed inside the metal member. Since the pad support is disposed opposite the heater, it is given a finish that locally or entirely reflects heat emitted by the heater to cause the reflected heat to irradiate an inner circumferential surface of the metal member, thus using the heat striking the pad support for effective heating of the metal member.

The above-described configuration is generally effective, and in part relies on the passage of recording medium through the nip to draw off the heat thus generated. However, a problem arises when relatively small recording media having a smaller width in the axial direction of the fixing belt are conveyed to the nip continuously. In that case, the lateral end portions of the fixing belt in the axial direction thereof may retain an excessive amount of heat because the small recording media do not pass through the lateral end portions of the fixing belt and therefore do not draw heat therefrom, resulting in overheating of the lateral end portions of the fixing belt and the corresponding sections of the metal member disposed opposite the lateral end portions of the fixing belt. Consequently, the fixing belt and the metal member may suffer from thermal damage.

BRIEF SUMMARY OF THE INVENTION

This specification describes below an improved fixing device. In one exemplary embodiment of the present invention, the fixing device fixes a toner image on a recording medium and includes a flexible, endless, belt-shaped fixing rotary body, a pressing rotary body, a nip formation pad, a substantially tubular, metal thermal conductor, a heater, a pad support, a reflector, and a plurality of reflector moving assemblies. The fixing rotary body is formed into a loop. The pressing rotary body is provided outside the loop formed by the fixing rotary body. The nip formation pad is provided inside the loop formed by the fixing rotary body and pressed against the pressing rotary body via the fixing rotary body to form a nip between the pressing rotary body and the fixing rotary body through which the recording medium bearing the toner image passes. The substantially tubular, metal thermal conductor is provided inside the loop formed by the fixing rotary body to heat the fixing rotary body. The heater is provided inside the metal thermal conductor to heat the metal thermal conductor. The pad support is provided inside the metal thermal conductor to support the nip formation pad. The reflector is provided between the heater and the pad support to reflect heat emitted by the heater thereto toward an inner circumferential surface of the metal thermal conductor. The reflector includes a center reflection portion provided at a center of the reflector in a longitudinal direction thereof, and a plurality of end reflection portions provided at respective lateral ends of the reflector in the longitudinal direction thereof, outboard of the center reflection portion. The plurality of reflector moving assemblies is connected to the plurality of end reflection portions of the reflector, respectively, to tilt the plurality of end reflection portions with respect to the center reflection portion.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
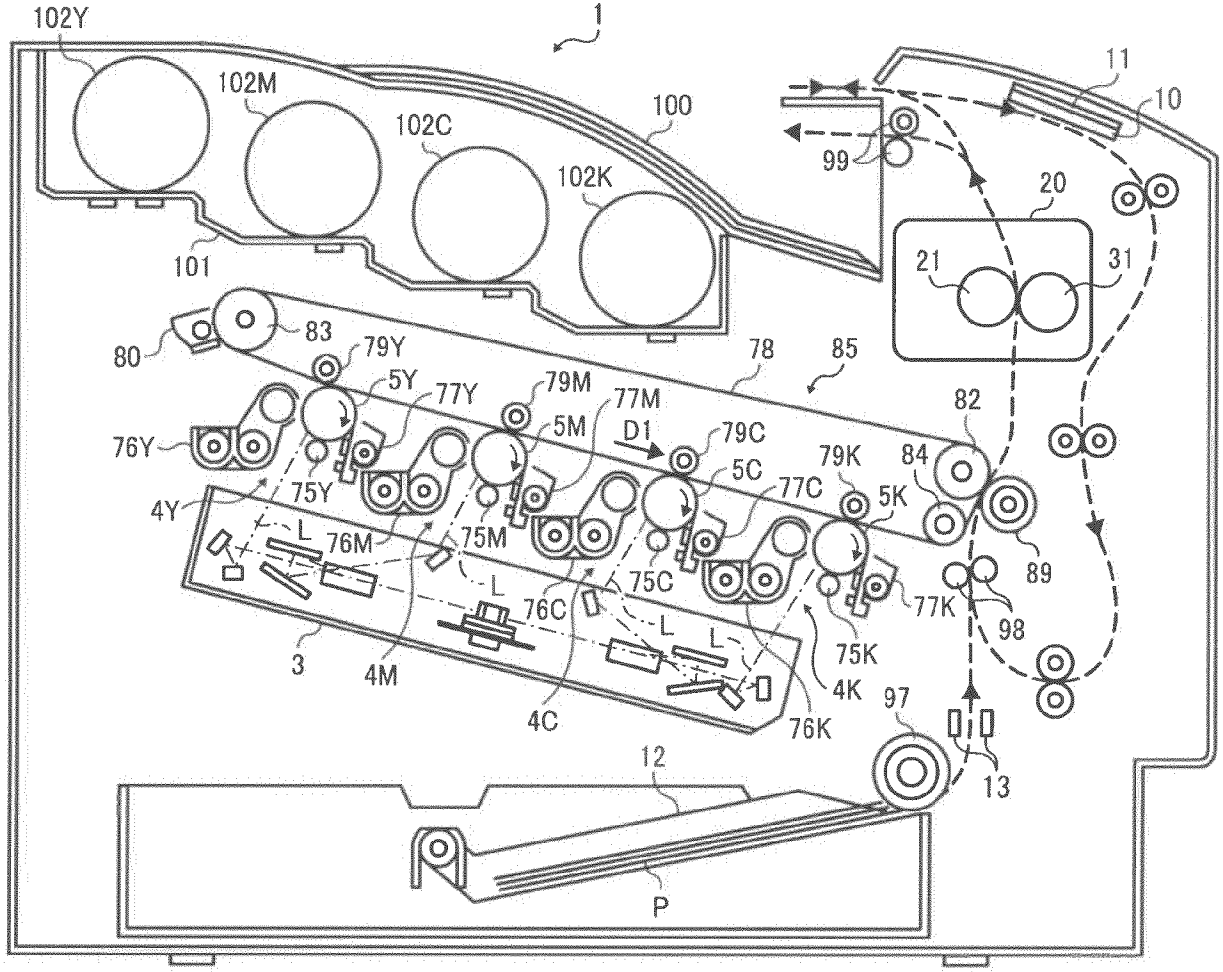
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 1, the image forming apparatus 1 includes image forming devices 4Y, 4M, 4C, and 4K disposed in a center portion of the image forming apparatus 1; a toner bottle holder 101 disposed above the image forming devices 4Y, 4M, 4C, and 4K in an upper portion of the image forming apparatus 1; an exposure device 3 disposed below the image forming devices 4Y, 4M, 4C, and 4K; a paper tray 12 disposed below the exposure device 3 in a lower portion of the image forming apparatus 1; an intermediate transfer unit 85 disposed above the image forming devices 4Y, 4M, 4C, and 4K; a second transfer roller 89 disposed opposite the intermediate transfer unit 85; a feed roller 97, a sheet size detector 13, and a registration roller pair 98 disposed between the paper tray 12 and the second transfer roller 89 in a conveyance direction of a recording medium P; a fixing device 20 disposed above the second transfer roller 89; an output roller pair 99 disposed above the fixing device 20; an output tray 100 disposed downstream from the output roller pair 99 in the conveyance direction of the recording medium P on top of the image forming apparatus 1; and a controller 10 and a control panel 11 disposed in the upper portion of the image forming apparatus 1.

The toner bottle holder 101 includes four toner bottles 102Y, 102M, 102C, and 102K that contain yellow, magenta, cyan, and black toners, respectively. They are detachably attached to the toner bottle holder 101, thus replaceable with new ones, respectively.

The intermediate transfer unit 85, disposed below the toner bottle holder 101, includes an intermediate transfer belt 78 formed into a loop, four first transfer bias rollers 79Y, 79M, 79C, and 79K, a second transfer backup roller 82, a cleaning backup roller 83, and a tension roller 84 disposed inside the loop formed by the intermediate transfer belt 78, and an intermediate transfer cleaner 80 disposed outside the loop formed by the intermediate transfer belt 78. Specifically, the intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction D1.

The image forming devices 4Y, 4M, 4C, and 4K, arranged opposite the intermediate transfer belt 78, form yellow, magenta, cyan, and black toner images, respectively. The image forming devices 4Y, 4M, 4C, and 4K include photoconductive drums 5Y, 5M, 5C, and 5K which are surrounded by chargers 75Y, 75M, 75C, and 75K, development devices 76Y, 76M, 76C, and 76K, cleaners 77Y, 77M, 77C, and 77K, and dischargers, respectively. Image forming processes including a charging process, an exposure process, a development process, a primary transfer process, and a cleaning process are performed on the photoconductive drums 5Y, 5M, 5C, and 5K to form yellow, magenta, cyan, and black toner images thereon, respectively, as a driving motor drives and rotates the photoconductive drums 5Y, 5M, 5C, and 5K clockwise in FIG. 1.

Specifically, in the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the respective photoconductive drums 5Y, 5M, 5C, and 5K according to image data sent from a client computer, for example. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively.

In the primary transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

The following describes the transfer processes, that is, the primary transfer process described above and a secondary transfer process, performed on the intermediate transfer belt 78. The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, in the primary transfer process, the yellow, magenta, cyan, and black toner images formed on the photoconductive drums 5Y, 5M, 5C, and 5K, respectively, are primarily transferred and superimposed onto the intermediate transfer belt 78 rotating in the direction D1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The second transfer roller 89 is pressed against the second transfer backup roller 82 via the intermediate transfer belt 78 in such a manner that the second transfer roller 89 and the second transfer backup roller 82 sandwich the intermediate transfer belt 78 to form a second transfer nip between the second transfer roller 89 and the intermediate transfer belt 78. At the second transfer nip, the second transfer roller 89 secondarily transfers the color toner image formed on the intermediate transfer belt 78 onto a recording medium P sent from the paper tray 12 through the feed roller 97 and the registration roller pair 98 in the secondary transfer process. Thus, the desired color toner image is formed on the recording medium P. After the transfer of the color toner image, residual toner, which has not been transferred onto the recording medium P, remains on the intermediate transfer belt 78.

Thereafter, the intermediate transfer cleaner 80 collects the residual toner from the intermediate transfer belt 78 at a cleaning position at which the intermediate transfer cleaner 80 is disposed opposite the cleaning backup roller 83 via the intermediate transfer belt 78, thus completing a single sequence of transfer processes performed on the intermediate transfer belt 78.

The recording medium P is supplied to the second transfer nip from the paper tray 12 which loads a plurality of recording media P (e.g., transfer sheets). Specifically, the feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. For example, the roller nip of the registration roller pair 98 contacts and stops a leading edge of the recording medium P. The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

After the secondary transfer process described above, the recording medium P bearing the color toner image is sent to the fixing device 20 that includes a fixing belt 21 and a pressing roller 31. The fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the output tray 100. Thus, the recording media P discharged by the output roller pair 99 are stacked on the output tray 100 successively to complete a single sequence of image forming processes performed by the image forming apparatus 1.

Figure 2:
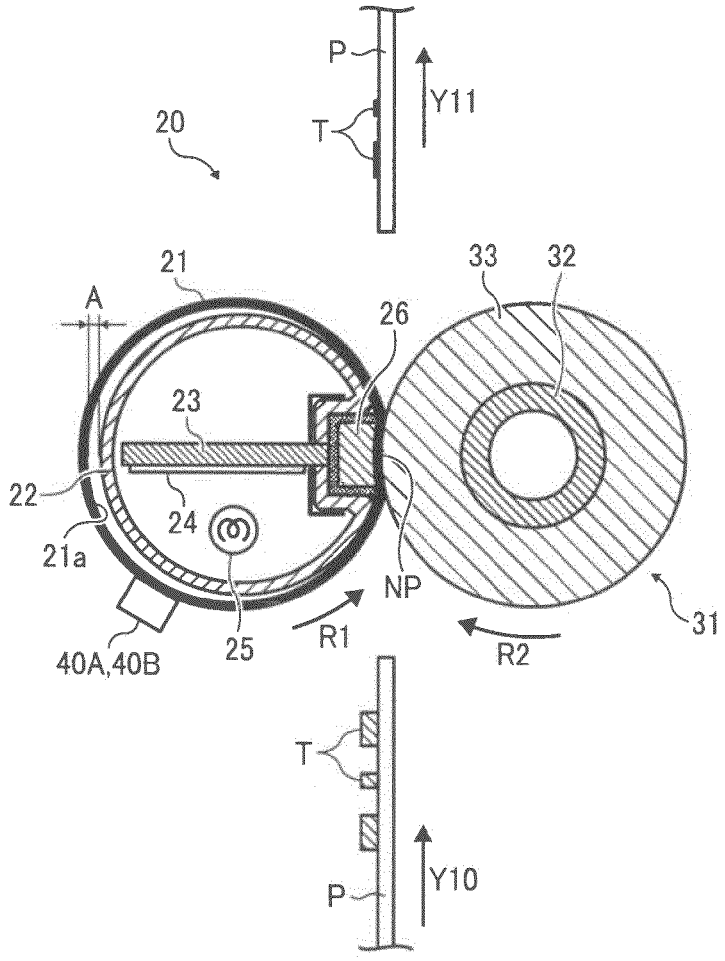
FIG. 2 is a vertical sectional view of a fixing device included in the image forming apparatus shown in FIG. 1.
Figure 3:
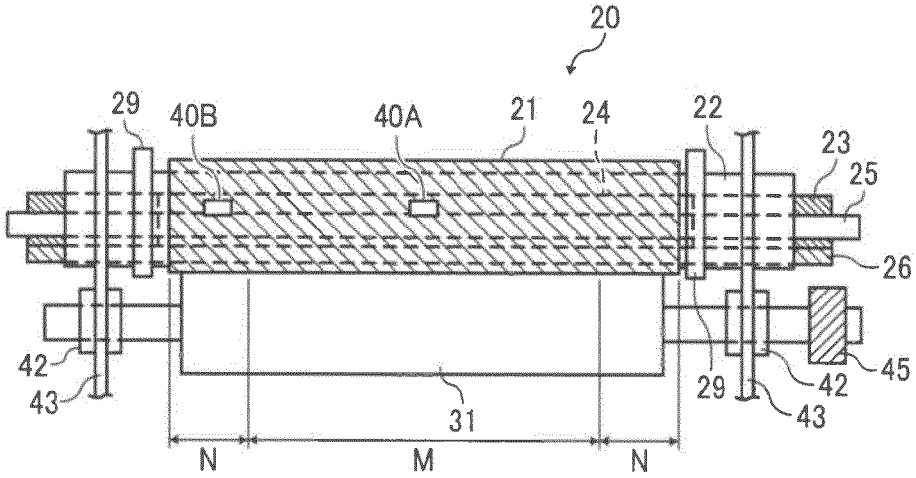
FIG. 3 is a plan view of the fixing device shown in FIG. 2.
Figure 4:
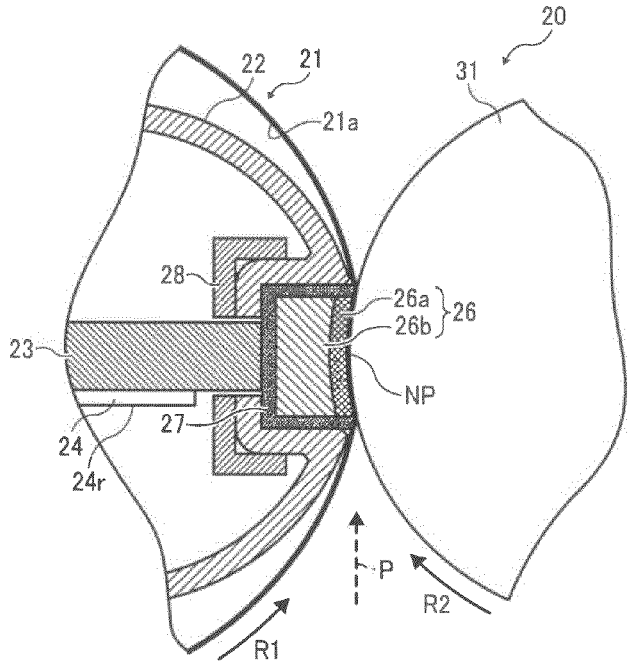
FIG. 4 is an enlarged vertical sectional view of the fixing device shown in FIG. 2.
Figure 5:
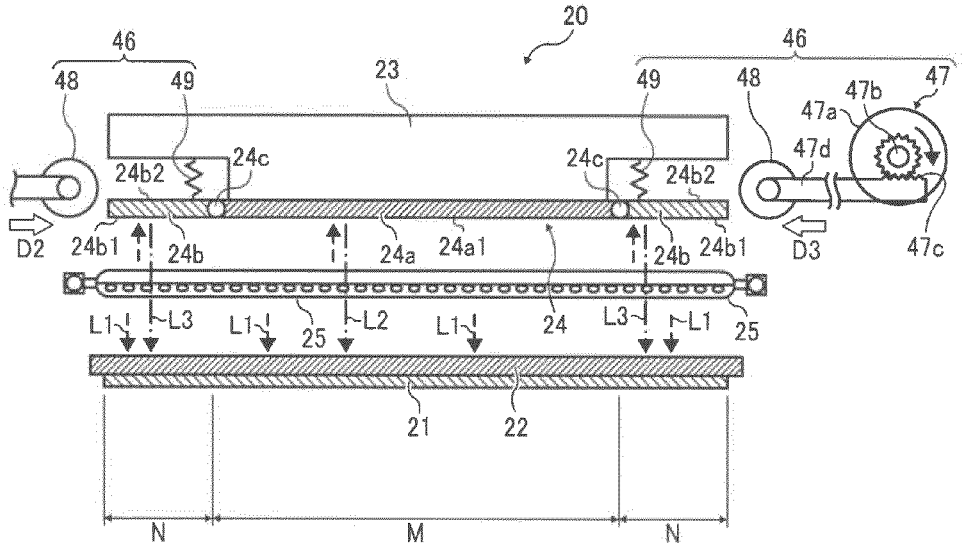
FIG. 5 is a horizontal sectional view of the fixing device shown in FIG. 2.
Figure 6:
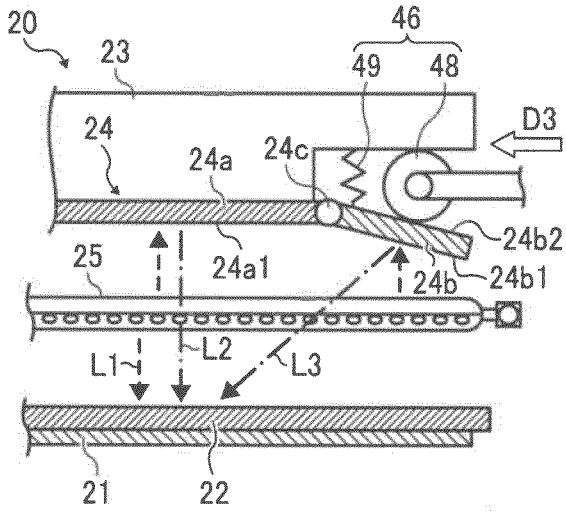
FIG. 6 is a partial horizontal sectional view of the fixing device shown in FIG. 5.

Referring to FIGS. 2 to 6, the following describes the structure and operation of the fixing device 20 installed in the image forming apparatus 1 described above. FIG. 2 is a vertical sectional view of the fixing device 20. FIG. 3 is a plan view of the fixing device 20. FIG. 4 is an enlarged vertical sectional view of the fixing device 20. FIG. 5 is a horizontal sectional view of the fixing device 20. FIG. 6 is a partial horizontal sectional view of the fixing device 20.

As illustrated in FIG. 2, the fixing device 20 includes the fixing belt 21 formed into a loop; a metal thermal conductor 22, a pad support 23, a reflector 24, a heater 25, and a nip formation pad 26, which are disposed inside the loop formed by the fixing belt 21; and the pressing roller 31, a first temperature sensor 40A, and a second temperature sensor 40B, which are disposed outside the loop formed by the fixing belt 21. As illustrated in FIG. 4, the fixing device 20 further includes a heat insulator 27 and a stay 28 disposed inside the loop formed by the fixing belt 21.

As illustrated in FIG. 2, the fixing belt 21 is a thin, flexible endless belt serving as a fixing member or a fixing rotary body that rotates counterclockwise in FIG. 2 in a rotation direction R1. The fixing belt 21, having a total thickness not greater than about 1 mm, is constructed of a base layer, an elastic layer disposed on the base layer, and a release layer disposed on the elastic layer.

Specifically, the base layer, having a thickness in a range of from about 30 μm to about 50 μm, constitutes an inner circumferential surface 21*a* of the fixing belt 21 sliding over the nip formation pad 26, and is made of a metal material such as nickel and/or stainless steel and/or a resin material such as polyimide.

The elastic layer, having a thickness in a range of from about 100 μm to about 300 μm, is made of a rubber material such as silicon rubber, silicon rubber foam, and/or fluorocarbon rubber. The elastic layer eliminates or reduces slight surface asperities of the fixing belt 21 at a nip NP formed between the fixing belt 21 and the pressing roller 31. Accordingly, heat is uniformly transmitted from the fixing belt 21 to a toner image T on a recording medium P, minimizing formation of a rough image such as an orange peel image.

The release layer, having a thickness in a range of from about 10 μm to about 50 μm, is made of tetrafluoroethylene-perfluoroalkylvinylether copolymer (PFA), polytetrafluoroethylene (PTFE), polyimide, polyetherimide, and/or polyether sulfide (PES). The release layer releases or separates the toner image T from the fixing belt 21.

The fixing belt 21 has a loop diameter in a range of from about 15 mm to about 120 mm. According to this exemplary embodiment, the fixing belt 21 has an inner diameter of about 30 mm. As illustrated in FIGS. 2 and 4, the nip formation pad 26, the heater 25, the metal thermal conductor 22, the pad support 23, the reflector 24, the heat insulator 27, and the stay 28 are disposed inside the loop formed by the fixing belt 21. In other words, they do not face an outer circumferential surface of the fixing belt 21, but face the inner circumferential surface 21*a* of the fixing belt 21.

The nip formation pad 26 is a stationary member that is fixedly disposed inside the fixing belt 21 in such a manner that the inner circumferential surface 21*a* of the fixing belt 21 slides over the nip formation pad 26. The nip formation pad 26 presses against the pressing roller 31 via the fixing belt 21 to form the nip NP between the fixing belt 21 and the pressing roller 31 through which the recording medium P bearing the toner image T is conveyed. As illustrated in FIG. 3, lateral ends of the nip formation pad 26 in a longitudinal direction thereof parallel to an axial direction of the fixing belt 21 are mounted on and supported by side plates 43 of the fixing device 20, respectively.

As illustrated in FIG. 2, the metal thermal conductor 22 (e.g., a metal member) has a substantially cylindrical, tubular, or pipe-shaped form. The metal thermal conductor 22 directly faces the inner circumferential surface 21*a* of the fixing belt 21 at a position other than the nip NP. At the nip NP, the metal thermal conductor 22 holds the nip formation pad 26 via the heat insulator 27 depicted in FIG. 4. As illustrated in FIG. 3, lateral ends of the metal thermal conductor 22 in a longitudinal direction thereof parallel to the axial direction of the fixing belt 21 are mounted on and supported by the side plates 43 of the fixing device 20, respectively. Flanges 29 are attached to the lateral ends of the metal thermal conductor 22 in the longitudinal direction thereof to restrict movement (e.g., shifting) of the fixing belt 21 in the axial direction thereof.

With this configuration, the metal thermal conductor 22 heated by radiation heat generated by the heater 25 serves as a heating member that heats the fixing belt 21 or a heat transmitter that transmits heat received from the heater 25 to the fixing belt 21. That is, the heater 25 heats the metal thermal conductor 22 directly and heats the fixing belt 21 indirectly via the metal thermal conductor 22. Preferably, the metal thermal conductor 22 has a thickness not greater than about 0.1 mm to maintain desired heating efficiency for heating the fixing belt 21.

The metal thermal conductor 22 is made of a metal thermal conductor, that is, a metal having thermal conductivity, such as stainless steel, nickel, aluminum, and/or iron. Preferably, the metal thermal conductor 22 is made of ferrite stainless steel having a relatively smaller heat capacity per unit volume obtained by multiplying density by specific heat. According to this exemplary embodiment, the metal thermal conductor 22, having a thickness of about 0.1 mm, is made of SUS430 stainless steel as ferrite stainless steel.

The heater 25, serving as a heater or a heat source, is a halogen heater or a carbon heater. As illustrated in FIG. 3, lateral ends of the heater 25 in a longitudinal direction thereof parallel to the axial direction of the fixing belt 21 are mounted on the side plates 43 of the fixing device 20, respectively. Radiation heat generated by the heater 25, which is controlled by a power source disposed in the image forming apparatus 1 depicted in FIG. 1, heats the metal thermal conductor 22. The metal thermal conductor 22 heats substantially the entire fixing belt 21, that is, a portion of the fixing belt 21 other than the nip NP. Heat is transmitted from the heated outer circumferential surface of the fixing belt 21 to the toner image T on the recording medium P.

As illustrated in FIG. 3, the fixing device 20 includes two temperature detectors (e.g., thermistors) that face the outer circumferential surface of the fixing belt 21 to detect a temperature thereof: the first temperature sensor 40A serving as a first temperature detector; and the second temperature sensor 40B serving as a second temperature detector. The controller 10 depicted in FIG. 1 may be configured as a central processing unit (CPU), provided with a random-access memory (RAM) and a read-only memory (ROM), and controls the heater 25 according to detection results provided by the first temperature sensor 40A and the second temperature sensor 40B so as to adjust the temperature (e.g., a fixing temperature) of the fixing belt 21 to a desired temperature.

As described above, the fixing device 20 according to this exemplary embodiment includes the two temperature detectors: the first temperature sensor 40A that detects the temperature of a center portion of the fixing belt 21 in the axial direction thereof; and the second temperature sensor 40B that detects the temperature of one of lateral end portions of the fixing belt 21 in the axial direction thereof. The center portion of the fixing belt 21 corresponds to a conveyance region M through which a small recording medium P passes. The lateral end portions of the fixing belt 21 correspond to non-conveyance regions N through which a small recording medium P does not pass. Since small recording media are used more frequently than large recording media, the controller 10 controls the heater 25 based on the temperature of the fixing belt 21 detected by the first temperature sensor 40A that faces the conveyance region M through which small recording media pass.

As described above, in the fixing device 20 according to this exemplary embodiment, the metal thermal conductor 22 does not heat only a small part of the fixing belt 21 but heats substantially the entire fixing belt 21 in a circumferential direction of the fixing belt 21. Accordingly, even when the image forming apparatus 1 depicted in FIG. 1 forms a toner image at high speed, the fixing belt 21 is heated enough to minimize fixing failure. In other words, the fixing device 20 heats the fixing belt 21 efficiently with the relatively simple structure, shortening a warm-up time and a first print time and downsizing the image forming apparatus 1.

As illustrated in FIG. 2, the substantially tubular metal thermal conductor 22 is disposed opposite the fixing belt 21 in such a manner that a certain clearance A is provided between the inner circumferential surface 21*a* of the fixing belt 21 and an outer circumferential surface of the metal thermal conductor 22 all along the inner circumferential surface 21*a* of the fixing belt 21 except for the nip NP. The clearance A, that is, a gap between the fixing belt 21 and the metal thermal conductor 22 at all sections along the inner circumferential surface 21*a* of the fixing belt 21 other than the nip NP, is not greater than 1 mm, expressed as 0 mm<A≤1 mm. Accordingly, the fixing belt 21 slidably contacts the metal thermal conductor 22 over a reduced area, thus minimizing wear of the fixing belt 21. At the same time, the clearance A provided between the metal thermal conductor 22 and the fixing belt 21 is small enough to prevent any substantial decrease in heating efficiency of the metal thermal conductor 22 for heating the fixing belt 21. Moreover, the metal thermal conductor 22 disposed close to the fixing belt 21 supports the fixing belt 21 and maintains the circular loop form of the flexible fixing belt 21, thus limiting degradation of and damage to the fixing belt 21 due to deformation of the fixing belt 21.

The inner circumferential surface 21*a* of the fixing belt 21 is applied with a lubricant, such as fluorine grease, to decrease friction between the fixing belt 21 and the metal thermal conductor 22 and concomitant wear of the fixing belt 21 that may arise as the fixing belt 21 slidably contacts the metal thermal conductor 22.

According to this exemplary embodiment, the metal thermal conductor 22 has a substantially circular shape in cross-section. Alternatively, the metal thermal conductor 22 may have a polygonal shape in cross-section or may include a slit on a circumferential surface thereof.

As illustrated in FIG. 2, the pad support 23, which is fixedly disposed inside the loop formed by the fixing belt 21 and faces the inner circumferential surface 21*a* of the fixing belt 21, serves as a reinforcement member that reinforces the nip formation pad 26 which forms the nip NP between the fixing belt 21 and the pressing roller 31. As illustrated in FIG. 3, a width of the pad support 23 in a longitudinal direction thereof parallel to the axial direction of the fixing belt 21 is equivalent to a width of the nip formation pad 26 in the longitudinal direction thereof parallel to the axial direction of the fixing belt 21. Lateral ends of the pad support 23 in the longitudinal direction thereof are mounted on the side plates 43 of the fixing device 20, respectively, in such a manner that the side plates 43 support the pad support 23. As illustrated in FIG. 2, the pad support 23 is pressed against the pressing roller 31 via the nip formation pad 26 and the fixing belt 21 to support the nip formation pad 26. Thus, the nip formation pad 26 is not deformed substantially even when it receives pressure from the pressing roller 31 at the nip NP.

In order to provide the above-described effects, the pad support 23 is preferably made of a metal material having great mechanical strength, such as stainless steel and/or iron.

According to this exemplary embodiment, the pad support 23 is a plate that divides the interior of the substantially cylindrical metal thermal conductor 22 into two communicable compartments: an upper compartment disposed downstream from the nip NP in the rotation direction R1 of the fixing belt 21 and a lower compartment disposed upstream from the nip NP in the rotation direction R1 of the fixing belt 21.

The reflector 24 is attached to the pad support 23 and includes heat-reflecting faces disposed opposite the heater 25 and extending in a longitudinal direction of the reflector 24 parallel to the axial direction of the fixing belt 21 so as to reflect heat, emitted by the heater 25 and irradiating the reflector 24, toward an inner circumferential surface of the metal thermal conductor 22. As illustrated in FIG. 5, the reflector 24 includes a first reflection plate 24*a* disposed at a center portion of the reflector 24 in the longitudinal direction thereof and a pair of second reflection plates 24*b* disposed at lateral end portions of the reflector 24 in the longitudinal direction thereof, respectively. Each of the second reflection plates 24*b* is rotated as needed about a rotation axis 24*c* by a reflector moving assembly 46, a detailed description of which is deferred.

With the configuration described above, the reflector 24, disposed between the heater 25 and the pad support 23, reflects heat emitted by the heater 25 thereto toward the metal thermal conductor 22 to heat it, improving efficiency of heating of the metal thermal conductor 22 for heating the fixing belt 21.

As illustrated in FIG. 2, the pressing roller 31 serves as a pressing rotary body that presses against the outer circumferential surface of the fixing belt 21 at the nip NP. The pressing roller 31, having a loop diameter of about 30 mm, is constructed of a hollow metal core 32 and an elastic layer 33 disposed on the metal core 32. The elastic layer 33 is made of silicon rubber foam, silicon rubber, and/or fluorocarbon rubber. Optionally, the pressing roller 31 may include a thin surface release layer, made of PFA and/or PTFE, disposed on the elastic layer 33. The pressing roller 31 is pressed against the fixing belt 21 to form the desired nip NP therebetween.

As illustrated in FIG. 3, the pressing roller 31 is mounted with a gear 45 engaging a driving gear of a driving mechanism that drives and rotates the pressing roller 31 clockwise in FIG. 2 in a rotation direction R2 counter to the rotation direction R1 of the fixing belt 21. Lateral ends of the pressing roller 31 in a longitudinal direction, that is, an axial direction thereof, are rotatably supported by the side plates 43 of the fixing device 20 via bearings 42, respectively. Optionally, a heat source, such as a halogen heater, may be disposed inside the pressing roller 31.

With the elastic layer 33 of the pressing roller 31 made of a sponge material such as silicon rubber foam, the pressing roller 31 applies decreased pressure to the fixing belt 21 at the nip NP to decrease bending of the metal thermal conductor 22. Further, the pressing roller 31 provides increased heat insulation, and thereby preventing easy transmission of heat from the fixing belt 21 to the pressing roller 31 and thus improving heating efficiency of the fixing belt 21.

According to this exemplary embodiment, the fixing belt 21 when formed into its looped shape has a diameter (hereinafter "loop diameter") identical to that of the pressing roller 31. Alternatively, the loop diameter of the fixing belt 21 may be smaller than that of the pressing roller 31. In this case, the curvature of the fixing belt 21 is smaller than that of the pressing roller 31 at the nip NP, facilitating separation of a recording medium P from the fixing belt 21 when it is discharged from the nip NP.

As illustrated in FIG. 4, the nip formation pad 26 is constructed of a base layer 26*b* and a surface layer 26*a* disposed on the base layer 26*b*. The base layer 26*b* of the nip formation pad 26 is made of a rigid material (e.g., a highly rigid metal or ceramic) that prevents the nip formation pad 26 from being bent substantially by pressure applied by the pressing roller 31. The inner circumferential surface 21*a* of the fixing belt 21 slides over the nip formation pad 26. The nip formation pad 26 constitutes an opposing face (e.g., a contact face that contacts the inner circumferential surface 21*a* of the fixing belt 21 sliding over the nip formation pad 26) facing the pressing roller 31 and having a concave shape corresponding to the curvature of the pressing roller 31. The recording medium P moves along the concave, opposing face of the nip formation pad 26 corresponding to the curvature of the pressing roller 31 and is discharged from the nip NP. Thus, the concave shape of the nip formation pad 26 prevents adhesion of the recording medium P bearing the fixed toner image T to the fixing belt 21, thereby facilitating separation of the recording medium P from the fixing belt 21.

As described above, according to this exemplary embodiment, the nip formation pad 26 has a concave shape to form the concave nip NP. Alternatively, however, the nip formation pad 26 may have a flat, planar shape to form a planar nip NP. Specifically, the contact face of the nip formation pad 26 disposed opposite the pressing roller 31 may have a flat, planar shape. Accordingly, the planar nip NP formed by the planar contact face of the nip formation pad 26 is substantially parallel to an imaged side of the recording medium P. Consequently, the fixing belt 21 pressed by the planar contact face of the nip formation pad 26 is precisely adhered to the recording medium P to improve fixing performance. Further, the increased curvature of the fixing belt 21 at an exit of the nip NP facilitates separation of the recording medium P discharged from the nip NP from the fixing belt 21.

The substantially tubular metal thermal conductor 22 is formed by bending a metal sheet into the desired shape. A metal sheet is used to give the metal thermal conductor 22 a thin thickness to shorten a warm-up time. However, such a thin metal thermal conductor 22 has little rigidity, and therefore is easily bent or deformed by pressure applied by the pressing roller 31. A deformed metal thermal conductor 22 does not provide a desired nip length of the nip NP, degrading fixing performance. To address this problem, according to this exemplary embodiment, the rigid nip formation pad 26 is provided separately from the thin metal thermal conductor 22 to help form and maintain the proper nip NP.

As illustrated in FIG. 4, the heat insulator 27 is disposed between the nip formation pad 26 and the heater 25 depicted in FIG. 2. Specifically, the heat insulator 27 is disposed between the nip formation pad 26 and the metal thermal conductor 22 in such a manner that the heat insulator 27 covers multiple faces of the nip formation pad 26 other than the contact face thereof over which the fixing belt 21 slides. The heat insulator 27 is made of sponge rubber having the desired heat insulation and/or a ceramic including air pockets.

The metal thermal conductor 22 is disposed close to the fixing belt 21 throughout substantially the entire circumference thereof. Accordingly, even in a standby mode before printing starts, the metal thermal conductor 22 heats the fixing belt 21 in the circumferential direction evenly, without temperature fluctuation. Consequently, the image forming apparatus 1 depicted in FIG. 1 starts printing as soon as it receives a print request. In conventional on-demand fixing devices including a fixing film having a decreased heat capacity, when the deformed pressing roller 31 is heated at the nip NP in the standby mode, it may suffer from thermal degradation due to heating of the rubber included therein, resulting in a shortened life or permanent compression strain. The permanent compression strain of the pressing roller 31 makes a dent in a part of the pressing roller 31, and therefore the pressing roller 31 does not provide the desired nip length of the nip NP, generating faulty fixing or noise in accordance with rotation of the pressing roller 31. To address those problems, according to this exemplary embodiment, the heat insulator 27 is disposed between the nip formation pad 26 and the metal thermal conductor 22 to reduce heat transmitted from the metal thermal conductor 22 to the nip formation pad 26 in the standby mode, minimizing heating of the deformed pressing roller 31 at high temperature in the standby mode.

Between the nip formation pad 26 and the fixing belt 21 is applied a lubricant that reduces frictional resistance therebetween, but it may deteriorate under high pressure and temperature applied at the nip NP, resulting in unstable slippage of the fixing belt 21 over the nip formation pad 26. To address this problem, according to this exemplary embodiment, the heat insulator 27 is provided between the nip formation pad 26 and the metal thermal conductor 22 to reduce heat transmitted from the metal thermal conductor 22 to the lubricant at the nip NP, thus reducing deterioration of the lubricant due to high temperature.

The heat insulator 27 disposed between the nip formation pad 26 and the metal thermal conductor 22 insulates the nip formation pad 26 from the metal thermal conductor 22. Accordingly, the metal thermal conductor 22 heats the fixing belt 21 with reduced heat at the nip NP. Consequently, the recording medium P discharged from the nip NP has a decreased temperature compared to when it enters the nip NP. In other words, at the exit of the nip NP, the fixed toner image T on the recording medium P has a decreased temperature, and therefore the toner of the fixed toner image T has a decreased viscosity. That is, with a decreased adhesive force that adheres the fixed toner image T to the fixing belt 21, the recording medium P is separated from the fixing belt 21 easily. Consequently, the recording medium P is not wound around the fixing belt 21 immediately after the fixing process, preventing or reducing jamming of the recording medium P and adhesion of the toner of the toner image T to the fixing belt 21.

As illustrated in FIG. 4, the stay 28 contacts an inner circumferential surface opposite an outer circumferential surface facing the heat insulator 27, of a concave portion of the metal thermal conductor 22 into which the nip formation pad 26 is inserted so as to hold the metal thermal conductor 22.

In the present embodiment, a stainless steel sheet having a thickness of about 0.1 mm is bent into the substantially tubular metal thermal conductor 22. However, spring-back of the stainless steel sheet may expand a circumference of the metal thermal conductor 22, and therefore the stainless steel sheet may not maintain the desired pipe shape. As a result, the metal thermal conductor 22 having an expanded circumference may contact the inner circumferential surface 21*a* of the fixing belt 21, damaging the fixing belt 21 or generating temperature fluctuation of the fixing belt 21 due to uneven contact of the metal thermal conductor 22 to the fixing belt 21.

To address those problems, according to this exemplary embodiment, the stay 28 supports and holds the concave portion (e.g., a bent portion) of the metal thermal conductor 22 provided with an opening so as to prevent deformation of the metal thermal conductor 22 due to spring-back. For example, the stay 28 is press-fitted to the concave portion of the metal thermal conductor 22 to contact the inner circumferential surface of the metal thermal conductor 22 while the shape of the metal thermal conductor 22 that is bent against spring-back of the stainless steel sheet is maintained.

Preferably, the metal thermal conductor 22 has a thickness not greater than about 0.2 mm to increase heating efficiency of the metal thermal conductor 22.

As described above, the metal sheet is bent into the substantially tubular, thin metal thermal conductor 22 to shorten a warm-up time, but lacks the rigidity to withstand deformation due to pressure from the pressing roller 31 and therefore is bent or deformed. Accordingly, the deformed metal thermal conductor 22 may not provide a desired nip length of the nip NP, resulting in degraded fixing performance. To address this problem, according to this exemplary embodiment, the concave portion of the thin metal thermal conductor 22 into which the nip formation pad 26 is inserted is isolated from the nip NP to prevent the metal thermal conductor 22 from receiving pressure from the pressing roller 31 directly.

Referring to FIGS. 1 and 2, the following describes operation of the fixing device 20 having the above-described structure.

When the image forming apparatus 1 is powered on, power is supplied to the heater 25, and the pressing roller 31 starts rotating in the rotation direction R2. Friction between the pressing roller 31 and the fixing belt 21 at the nip NP rotates the fixing belt 21 in the rotation direction R1 in accordance with rotation of the pressing roller 31.

Thereafter, a recording medium P is sent from the paper tray 12 to the second transfer nip formed between the intermediate transfer belt 78 and the second transfer roller 89. At the second transfer nip, a color toner image is transferred from the intermediate transfer belt 78 onto the recording medium P. A guide plate guides the recording medium P bearing the toner image T in a direction Y10 so that the recording medium P enters the nip NP formed between the fixing belt 21 and the pressing roller 31 pressed against each other.

At the nip NP, the fixing belt 21 heated by the heater 25 via the metal thermal conductor 22 heats the recording medium P. Simultaneously, the pressing roller 31 and the nip formation pad 26 reinforced by the pad support 23 apply pressure to the recording medium P. Thus, the heat applied by the fixing belt 21 and the pressure applied by the pressing roller 31 fix the toner image T on the recording medium P. Thereafter, the recording medium P bearing the fixed toner image T discharged from the nip NP is conveyed in a direction Y11.

Referring to FIGS. 4, 5, and 6, the following describes the structure and operation of the fixing device 20 according to a first illustrative embodiment in detail.

As illustrated in FIGS. 4 and 5, the reflector 24 (e.g., a reflection plate) attached to the pad support 23 includes a reflection face 24*r* that reflects heat (e.g., infrared rays) emitted by the heater 25 thereto toward the inner circumferential surface of the metal thermal conductor 22. Lateral end portions of the reflection face 24*r* of the reflector 24 in the longitudinal direction of the reflector 24 are rotated and tilted toward a center portion of the reflection face 24*r* of the reflector 24 in the longitudinal direction thereof.

For example, the reflector 24 is constructed of two types of reflection plates: the first reflection plate 24*a* and the pair of second reflection plates 24*b*. The first reflection plate 24*a*, that is, a stationary reflection plate serving as a center reflection portion, is fixedly mounted on a center portion of the pad support 23 in the longitudinal direction thereof corresponding to the conveyance region M through which a small recording medium P is conveyed. By contrast, the second reflection plates 24*b*, that is, movable reflection plates serving as end reflection portions, are disposed at lateral end portions of the pad support 23 in the longitudinal direction thereof corresponding to the non-conveyance regions N through which a small recording medium P is not conveyed, respectively. Each of the second reflection plates 24*b* is supported by the pad support 23 in such a manner that it is rotatable about the rotation axis 24*c* attached to the first reflection plate 24*a*. Specifically, the reflector moving assembly 46 rotates the second reflection plate 24*b* about the rotation axis 24*c* as needed from the position of the second reflection plate 24*b* illustrated in FIG. 5 to the position of the second reflection plate 24*b* illustrated in FIG. 6.

The reflection face 24*r* of the reflector 24 is constructed of reflection faces of the first reflection plate 24*a* and the second reflection plates 24*b*, each of which is made of aluminum and/or silver having a smaller surface radiation and a greater degree of reflection of heat emitted by the heater 25.

Referring to FIGS. 5 and 6, the following describes the reflector moving assemblies 46 in detail. Each reflector moving assembly 46 uses a cam follower to move the second reflection plate 24*b*. For example, the reflector moving assembly 46 includes a cam roller 48, a tension spring 49 serving as a biasing member, and a driver 47 that moves the cam roller 48 in the axial direction of the fixing belt 21.

Specifically, the driver 47 includes a motor 47*a*; a pinion 47*b* rotated by the motor 47*a*; a rack 47*c* moved by the rotating pinion 47*b*; and a lever 47*d* mounted with the rack 47*c* and connected to the cam roller 48. When the motor 47*a* rotates the pinion 47*b* clockwise in FIG. 5, the rack 47*c* engaging the pinion 47*b* moves the lever 47*d* leftward in FIG. 5, moving the cam roller 48 in a direction D3. Although not shown, another driver 47 is also provided for the left reflector moving assembly 46 to move the left cam roller 48 in a direction D2.

As described above, the left, reflector moving assembly 46 moves the cam roller 48 in the direction D2 and the right, reflector moving assembly 46 moves the cam roller 48 in the direction D3. Specifically, the driver 47 moves the cam roller 48 in the axial direction of the fixing belt 21 in such a manner that the cam roller 48 contacts a non-reflection face 24*b*2 of the second reflection plate 24*b* opposite a reflection face 24*b*1 that reflects heat emitted by the heater 25, and at the same time biases the second reflection plate 24*b*, so that the reflection face 24*b*1 of the second reflection plate 24*b* is rotated and tilted toward a reflection face 24*a*1 of the first reflection plate 24*a* disposed at the center portion of the reflector 24 in the longitudinal direction thereof. The tension spring 49 biases (e.g., pulls and rotates) the second reflection plate 24*b* to align the reflection face 24*b*1 of the second reflection plate 24*b* with the reflection face 24*a*1 of the first reflection plate 24*a*.

For example, when the cam roller 48 is at the position illustrated in FIG. 5, the second reflection plate 24*b* biased by the tension spring 49 engages an engagement portion disposed on the pad support 23 that stops the second reflection plate 24*b* so that the reflection face 24*b*1 of the second reflection plate 24*b* and the reflection face 24*a*1 of the first reflection plate 24*a* are on an identical virtual plane as illustrated in FIG. 5. With this configuration, heat L1 (e.g., light) indicated by the broken line, which is emitted by the heater 25 to irradiate the metal thermal conductor 22 directly, travels in a direction orthogonal to the inner circumferential surface of the metal thermal conductor 22. Similarly, heat L2 (e.g., light) indicated by the alternate long and short dashed line, which is emitted by the heater 25 to irradiate the reflector 24 directly in a direction orthogonal to the reflection face 24*r* of the reflector 24 and then reflected by the reflector 24, travels in the direction orthogonal to the inner circumferential surface of the metal thermal conductor 22.

By contrast, as shown in FIG. 6, when the driver 47 depicted in FIG. 5 moves the cam roller 48 toward the first reflection plate 24*a*, the cam roller 48 presses the second reflection plate 24*b* downward in FIG. 6 against a biasing force applied by the tension spring 49 to tilt the second reflection plate 24*b* toward the first reflection plate 24*a*. With this configuration, heat L3 (e.g., light) indicated by the alternate long and short dashed line, which is emitted by the heater 25 to irradiate the reflector 24 directly and then reflected by the second reflection plate 24*b* of the reflector 24, travels in a direction oblique to the inner circumferential surface of the metal thermal conductor 22 toward a center portion of the metal thermal conductor 22 in the longitudinal direction thereof. That is, heat is concentrated at the center portion of the metal thermal conductor 22 in the longitudinal direction thereof.

Whether or not the above-described movement of the second reflection plates 24*b* is performed is determined by the size of the recording medium P in the axial direction of the fixing belt 21, that is, the width of the recording medium P passing through the nip NP formed between the fixing belt 21 and the pressing roller 31 depicted in FIG. 4. Specifically, when a small recording medium P having a smaller width in the axial direction of the fixing belt 21 is conveyed to the nip NP, the second reflection plates 24*b* disposed at the lateral end portions of the reflector 24 in the longitudinal direction thereof, respectively, are tilted toward the first reflection plate 24*a* disposed at the center portion of the reflector 24 in the longitudinal direction thereof. By contrast, when a maximum recording medium P that the image forming apparatus 1 depicted in FIG. 1 can accommodate, for example, an A3 size recording medium P, is conveyed to the nip NP, the maximum recording medium P passes through the entire width of the fixing belt 21 corresponding to both the conveyance region M and the non-conveyance regions N depicted in FIG. 5, that is, the whole region of the fixing belt 21 that can be heated by the heater 25. Accordingly, the cam rollers 48 are isolated from the second reflection plates 24*b*, respectively, as illustrated in FIG. 5. Consequently, the inner circumferential surface of the metal thermal conductor 22 is irradiated substantially uniformly over the longitudinal direction thereof by the heat L1 emitted by the heater 25 directly onto the metal thermal conductor 22, the heat L2 emitted by the heater 25 and then reflected by the first reflection plate 24*a*, and the heat L3 emitted by the heater 25 and then reflected by the second reflection plates 24*b* as illustrated in FIG. 5. Thus, the metal thermal conductor 22 heats the fixing belt 21 uniformly over the whole region in the axial direction thereof, that is, across the conveyance region M and the non-conveyance regions N. As a result, the toner image T is fixed on the maximum recording medium P properly over the entire width of the maximum recording medium P corresponding to the conveyance region M and the non-conveyance regions N.

Conversely, when the small recording medium P (e.g., an A4 size recording medium P) is conveyed to the nip NP, it passes over the conveyance region M of the fixing belt 21 only. Accordingly, the second reflection plates 24*b* are tilted toward the center portion of the fixing belt 21 in the axial direction thereof as illustrated in FIG. 6. Consequently, the heat L3 emitted by the heater 25 to the second reflection plates 24*b* is reflected by the second reflection plates 24*b*, and then irradiates the center portion of the metal thermal conductor 22 corresponding to the center portion of the fixing belt 21 in the axial direction thereof. On the other hand, the heat L2 emitted by the heater 25 to the first reflection plate 24*a* is reflected by the first reflection plate 24*a*, and then irradiates the center portion of the metal thermal conductor 22 corresponding to the center portion of the fixing belt 21 in the axial direction thereof, that is, the conveyance region M of the fixing belt 21. In other words, the heat L3 reflected by the second reflection plates 24*b* barely reaches lateral end portions of the metal thermal conductor 22 corresponding to the non-conveyance regions N disposed at the lateral end portions of the fixing belt 21 in the axial direction thereof, reducing localized overheating of the fixing belt 21 and the metal thermal conductor 22 in the non-conveyance regions N. By contrast, the conveyance region M of the fixing belt 21 is heated by the heat L1 emitted by the heater 25 directly to the center portion of the metal thermal conductor 22, the heat L2 emitted by the heater 25 to the first reflection plate 24*a* and then reflected by the first reflection plate 24*a* toward the center portion of the metal thermal conductor 22, and the heat L3 emitted by the heater 25 to the second reflection plates 24*b* and then reflected by the second reflection plates 24*b* toward the center portion of the metal thermal conductor 22. Thus, the center portion of the fixing belt 21 in the axial direction thereof is heated by the center portion of the metal thermal conductor 22 in the longitudinal direction thereof efficiently, providing improved fixing of the toner image T on the small recording medium P over the conveyance region M thereon.

Accordingly, even when small recording media P are conveyed to the nip NP continuously, the non-conveyance regions N of the fixing belt 21 through which the small recording media P do not pass are not overheated because the non-conveyance regions N are hardly heated by the heater 25. Consequently, even when a large recording medium P is conveyed to the nip NP immediately after the small recording media P, the occurrence of hot offset, which may arise due to an excessively high temperature of the lateral end portions of the fixing belt 21 in the axial direction thereof, can be minimized. Further, for a small recording medium P, the heat L3 emitted by lateral end portions of the heater 25 in the longitudinal direction thereof corresponding to the non-conveyance regions N and then reflected by the second reflection plates 24*b* is used effectively to heat the center portion of the fixing belt 21 in the axial direction thereof corresponding to the conveyance region M, resulting in effective usage of thermal energy of the heater 25.

It is to be noted that the controller 10 depicted in FIG. 1, which controls the above-described movement of the second reflection plates 24*b*, identifies the size, that is, the width in the axial direction of the fixing belt 21, of the recording medium P based on a signal sent from the sheet size detector 13 (e.g., a sensor) disposed in a conveyance path between the paper tray 12 to the fixing device 20 through which the recording medium P is conveyed or a signal sent from the control panel 11, disposed atop the image forming apparatus 1, for example, with which a user specifies the size of the recording medium P.

Figure 7A:
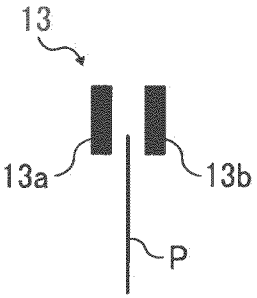
FIG. 7A is a vertical sectional view of a sheet size detector included in the image forming apparatus shown in FIG. 1.
Figure 7B:
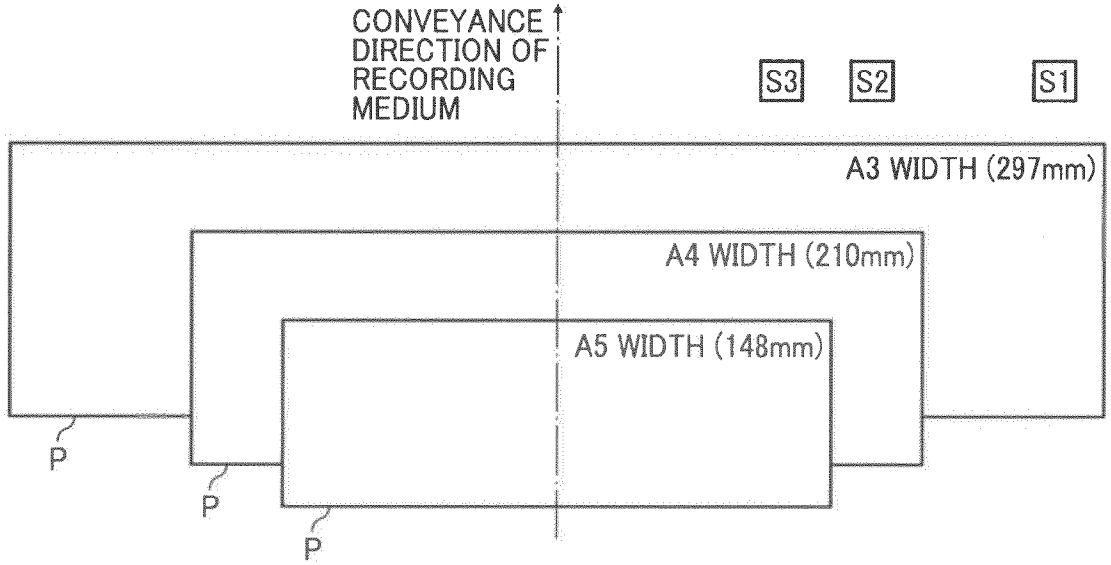
FIG. 7B is a plan view of various sizes of recording media conveyed through the sheet size detector shown in FIG. 7A.
Figure 7C:
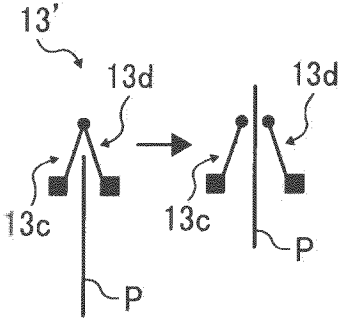
FIG. 7C is a vertical sectional view of an alternative sheet size detector included in the image forming apparatus shown in FIG. 1.

Referring to FIGS. 7A, 7B, and 7C, the following describes the sheet size detector 13 that detects the size of the recording medium P. FIG. 7A is a vertical sectional view of the sheet size detector 13. As illustrated in FIG. 7A, the sheet size detector 13 is a non-contact photo sensor constructed of multiple pairs of a light emitter 13*a* and a light receiver 13*b*.

For example, the multiple pairs of the light emitter 13*a* and the light receiver 13*b* are disposed at positions S1, S2, and S3 aligned in a line orthogonal to the conveyance direction of the recording medium P, respectively, as shown in FIG. 7B, on either side of the recording medium P conveyed from the paper tray 12 depicted in FIG. 1. When the recording medium P blocks light emitted from the light emitter 13*a* to the light receiver 13*b*, the sheet size detector 13 outputs an OFF signal to the controller 10 depicted in FIG. 1. When the recording medium P does not pass between the light emitter 13*a* and the light receiver 13*b*, the sheet size detector 13 outputs an ON signal to the controller 10. Thus the controller 10 detects the size (e.g., the width) of the recording medium P based on the combination of signals output by the multiple pairs of the light emitter 13*a* and the light receiver 13*b*.

Specifically, when a small recording medium (e.g., an A5 size recording medium) passes through the sheet size detector 13, only the pair of the light emitter 13*a* and the light receiver 13*b*, disposed at the position S3 corresponding to one lateral edge of the small recording medium P outputs an OFF signal. When a medium recording medium (e.g., an A4 size recording medium) passes through the sheet size detector 13, the pair of the light emitter 13*a* and the light receiver 13*b*, disposed at the position S2 corresponding to one lateral edge of the medium recording medium P as well as the pair of the light emitter 13*a* and the light receiver 13*b* disposed at the position S3 output an OFF signal. When a large recording medium (e.g., an A3 size recording medium) passes through the sheet size detector 13, the pair of the light emitter 13*a* and the light receiver 13*b*, disposed at the position S1 corresponding to one lateral edge of the large recording medium P as well as the pairs of the light emitter 13*a* and the light receiver 13*b* disposed at the positions S2 and S3 output an OFF signal.

FIG. 7C is a vertical sectional view of an alternative sheet size detector 13', that is, a contact electrode sensor, constructed of multiple pairs of electrodes 13*c* and 13*d*. Similar to the multiple pairs of the light emitter 13*a* and the light receiver 13*b* described above, the multiples pairs of electrodes 13*c* and 13*d* are disposed at the positions S1, S2, and S3 shown in FIG. 7B, respectively, sandwiching the recording medium P as illustrated in FIG. 7C. Before the electrodes 13*c* and 13*d* sandwich the recording medium P, they contact each other as shown in the left diagram in FIG. 7C. By contrast, when the electrodes 13*c* and 13*d* sandwich the recording medium P as shown in the right diagram in FIG. 7C, the sheet size detector 13' outputs an OFF signal.

Alternatively, the sheet size detector may be provided in the paper tray 12 depicted in FIG. 1 below recording media P, and include, for example, a movable guide contacting a lateral edge of the recording media P loaded on the paper tray 12 and a sensor that detects the position of the guide. Since the position of the guide varies depending on the size of the recording media P, the sensor detects the size of them based on the position of the guide.

Alternatively, the controller 10 may control movement of the second reflection plates 24*b* based on a temperature differential between the center portion and the lateral end portions of the fixing belt 21 in the axial direction thereof. For example, when a surface temperature of the lateral end portions of the fixing belt 21 in the axial direction thereof is higher than a surface temperature of the center portion of the fixing belt 21 in the axial direction thereof by a predetermined value, the reflection face 24*b*1 of each of the second reflection plates 24*b* may be tilted toward the center portion of the fixing belt 21 in the axial direction thereof as shown in FIG. 6.

For example, when the controller 10 identifies that the temperature differential between the center portion and the lateral end portions of the fixing belt 21 in the axial direction thereof is not smaller than the predetermined value based on the surface temperature of the center portion of the fixing belt 21 detected by the first temperature sensor 40A and the surface temperature of one lateral end portion of the fixing belt 21 detected by the second temperature sensor 40B depicted in FIG. 3, the controller 10 determines that the lateral end portions of the fixing belt 21 in the axial direction thereof are overheated, tilting the second reflection plates 24*b* from the position shown in FIG. 5 to the position shown in FIG. 6, thus providing effects equivalent to the effects described above, which are provided by controlling the movement of the second reflection plates 24*b* according to the size of the recording medium P.

It is to be noted that the angle of tilting of the second reflection plates 24*b* can be adjusted according to the size of the smaller recording medium P: A4 size or A5 size. For example, in the image forming apparatus 1 that accommodates A3 size as the maximum size of recording media P, A4 size and A5 size are identified as the size of smaller recording media P. Therefore, the controller 10 adjusts the position of the cam rollers 48 to cause the angle of tilting of the second reflection plates 24*b* for A5 size recording media P to be greater than that for A4 size recording media P. Specifically, the controller 10 controls the driver 47 that moves the cam roller 48 in such a manner that, for A5 size recording media P, the cam roller 48 is positioned at a first position provided inward in the longitudinal direction of the reflector 24 from a lateral edge of the second reflection plate 24*b* toward the first reflection plate 24*a*, which is closer to the first reflection plate 24*a* than a second position of the cam roller 48 for A4 size recording media P. With this configuration, even when recording media P of various sizes are conveyed to the nip NP, the second reflection plates 24*b* can precisely reflect the heat L3 to the conveyance region M.

The above-described configuration of the fixing device 20 includes the reflector 24 in which the second reflection plates 24*b* are tiltably disposed at the lateral end portions of the pad support 23 in the longitudinal direction thereof on a surface of the pad support 23 facing the heater 25. Thus, even when small recording media P pass through the nip NP continuously, the lateral end portions of the fixing belt 21 and the metal thermal conductor 22 in the longitudinal direction thereof, through which the small recording media P do not pass, are not overheated. Simultaneously, heat emitted from the heater 25 toward the pad support 23 is reflected by the reflector 24 and used for heating the metal thermal conductor 22, further improving efficiency for heating the fixing belt 21 and the metal thermal conductor 22.

According to this exemplary embodiment, although the reflector 24 is made of a relatively thin plate, it is mounted on the rigid pad support 23, and therefore is not deformed by stress exerted thereon. Accordingly, the reflector 24 itself does not require an increased mechanical strength, reducing manufacturing costs, downsizing the reflector 24, and saving space.

As described above, referring to FIG. 2, the pad support 23 defines a horizontal border between the two compartments inside the substantially tubular metal thermal conductor 22, the upper compartment downstream from the nip NP and the lower compartment upstream from the nip NP in the rotation direction R1 of the fixing belt 21. The heater 25 and the reflector 24 are disposed in the lower compartment, with the heater 25 disposed at substantially a center position in the lower compartment.

Since the pressing roller 31 applies a greater tension to an upstream portion of the fixing belt 21 upstream from the nip NP in the rotation direction R1 of the fixing belt 21 than to a downstream portion of the fixing belt 21 downstream from the nip NP, a smaller clearance is provided between the inner circumferential surface 21*a* of the fixing belt 21 and the outer circumferential surface of the metal thermal conductor 22 in the upstream portion of the fixing belt 21. Generally, the overall clearance between the fixing belt 21 and the metal thermal conductor 22 is small, but in the upstream portion of the fixing belt 21 the clearance becomes even smaller due to tension applied by the pressing roller 31, facilitating heat transmission from the metal thermal conductor 22 to the fixing belt 21. To benefit from this configuration, the heater 25 is disposed in the lower compartment inside the metal thermal conductor 22. Specifically, the heater 25 is disposed at substantially the center position of the lower compartment so that heat emitted by the heater 25 and reflected by the reflector 24 is diffused uniformly throughout the inner circumferential surface of the metal thermal conductor 22 in a circumferential direction thereof.

As described above, according to this exemplary embodiment, with the reflector 24 extending in the axial direction of the fixing belt 21 to reflect heat emitted by the heater 25 thereto toward the inner circumferential surface of the metal thermal conductor 22, the reflection face 24*b*1 of each of the second reflection plates 24*b* disposed at the lateral end portions of the reflector 24 in the longitudinal direction thereof is rotated (e.g., tilted) toward the reflection face 24*a*1 of the first reflection plate 24*a* disposed at the center portion of the reflector 24 in the longitudinal direction thereof, thus shortening a warm-up time and a first print time of the fixing device 20. Even when the fixing belt 21 of the fixing device 20 is rotated at high speed, the fixing belt 21 is heated to a desired fixing temperature quickly, preventing formation of a faulty toner image due to a low temperature of the fixing belt 21. Further, even when small recording media P are conveyed to the nip NP continuously, the non-conveyance regions N of the fixing belt 21 and the metal thermal conductor 22, through which the small recording media P do not pass, are not overheated.

It is to be noted that, according to this exemplary embodiment, a single second reflection plate 24*b*, that is, a movable reflection plate, is disposed at each lateral end portion of the reflector 24 in the longitudinal direction thereof. Alternatively, a plurality of second reflection plates 24*b* may be provided at each lateral end portion of the reflector 24 in the longitudinal direction thereof so that the reflector 24 can accommodate multiple sizes of smaller recording media P. The plurality of second reflection plates 24*b* at each lateral end portion of the reflector 24 in the longitudinal direction thereof is then selectively tilted according to the size of smaller recording media P. That is, even when smaller recording media P of multiple sizes are conveyed to the nip NP, and therefore the width of the conveyance region M in the axial direction of the fixing belt 21 varies depending on the size of smaller recording media P, the selectively tilted second reflection plates 24*b* at each lateral end portion of the reflector 24 can precisely reflect heat onto the conveyance region M of various widths.

Figure 8:
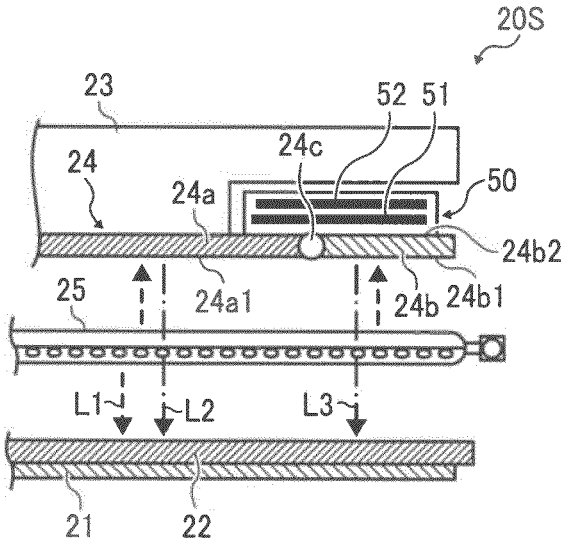
FIG. 8 is a partial horizontal sectional view of a fixing device according to another exemplary embodiment of the present invention, showing a state in which a second reflection plate included in the fixing device is not tilted.
Figure 9:
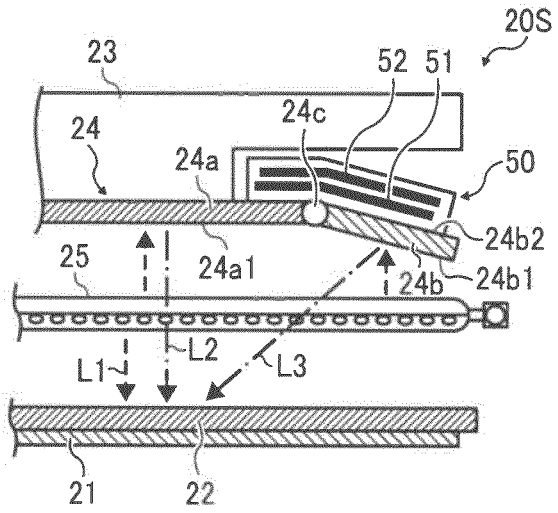
FIG. 9 is a partial horizontal sectional view of the fixing device shown in FIG. 8, showing a state in which the second reflection plate is tilted.

Referring to FIGS. 8 and 9, the following describes a fixing device 20S, installed with an actuator 50 serving as a reflector moving assembly, according to a second illustrative embodiment of the present invention.

FIG. 8 is a partial horizontal sectional view of the fixing device 20S in a state in which the second reflection plate 24*b* is not tilted. FIG. 9 is a partial horizontal sectional view of the fixing device 20S in a state in which the second reflection plate 24*b* is tilted. As illustrated in FIGS. 8 and 9, the mechanism that tilts the second reflection plate 24*b* employed in the fixing device 20S, that is, the actuator 50, is different from the mechanism employed in the fixing device 20 depicted in FIG. 5, that is, the reflector moving assembly 46, according to the first illustrative embodiment.

Similar to the fixing device 20 according to the first illustrative embodiment shown in FIG. 2, the fixing device 20S according to the second illustrative embodiment includes the fixing belt 21, the nip formation pad 26, the metal thermal conductor 22, the pad support 23, the reflector 24, the heater 25, the pressing roller 31, the first temperature sensor 40A, the second temperature sensor 40B, the heat insulator 27, and the stay 28. For example, the reflector 24 includes the stationary, first reflection plate 24*a* and the movable, second reflection plates 24*b* that are rotated by the reflector moving assemblies.

Referring to FIGS. 8 and 9, a detailed description is now given of the reflector moving assemblies employed in the fixing device 20S, that is, the actuators 50.

The actuator 50 is disposed at each lateral end of the pad support 23 in the longitudinal direction thereof. It is to be noted that FIGS. 8 and 9 illustrate the actuator 50 disposed at one lateral end of the pad support 23, omitting another actuator 50 disposed at another lateral end of the pad support 23. The actuator 50 includes two plate-shaped, shape-memory alloys, a first shape-memory alloy 51 and a second shape-memory alloy 52. Each of the first shape-memory alloy 51 and the second shape-memory alloy 52 is attached, via a soft protection material, to the non-reflection face 24*b*2 of the second reflection plate 24*b* opposite the reflection face 24*b*1 that reflects heat emitted by the heater 25. Specifically, the first shape-memory alloy 51, when deformed by heat generated by the heater 25 after the fixing device 20S is powered on, biases the second reflection plate 24*b* to rotate and tilt the reflection face 24*b*1 of the second reflection plate 24*b* toward the reflection face 24*a*1 of the first reflection plate 24*a*, that is, the center portion of the fixing belt 21 in the axial direction thereof. By contrast, the second shape-memory alloy 52, when deformed by heat generated by the heater 25 after the fixing device 20S is powered on, biases the second reflection plate 24*b* to rotate the reflection face 24*b*1 of the second reflection plate 24*b* to be aligned with the reflection face 24*a*1 of the first reflection plate 24*a*.

The first shape-memory alloy 51 and the second shape-memory alloy 52 are connected to respective power sources and electric wiring to receive power from the power sources via the electric wiring.

For example, when power is supplied from the power source to the first shape-memory alloy 51 to heat it by electric resistance, the first shape-memory alloy 51 is bent into a substantially L-shaped form due to its shape-memory function as illustrated in FIG. 9. Simultaneously, the second shape-memory alloy 52, which is not supplied with power and therefore is not heated, is also bent in accordance with deformation of the first shape-memory alloy 51. Moreover, the second reflection plate 24*b*, biased by the first shape-memory alloy 51 of the actuator 50, is tilted toward the first reflection plate 24*a*, that is, the center portion of the fixing belt 21 in the axial direction thereof as illustrated in FIG. 9. With this configuration, the heat L2 and the heat L3 emitted by the heater 25 to directly irradiate the reflection face 24*a*1 of the first reflection plate 24*a* and the reflection face 24*b*1 of the second reflection plate 24*b* and then reflected by them, respectively, are concentrated on the center portion on the inner circumferential surface of the metal thermal conductor 22 in the longitudinal direction thereof.

By contrast, when power is supplied from the power source to the second shape-memory alloy 52 to heat it by electric resistance, the second shape-memory alloy 52 is deformed into a planar shape due to its shape-memory function as illustrated in FIG. 8. Simultaneously, the first shape-memory alloy 51, which is not supplied with power and therefore is not heated, is also deformed into a planar shape in accordance with deformation of the second shape-memory alloy 52. Moreover, the second reflection plate 24*b*, biased by the second shape-memory alloy 52 of the actuator 50, is deformed into a planar shape in such a manner that the reflection face 24*b*1 of the second reflection plate 24*b* and the reflection face 24*a*1 of the first reflection plate 24*a* are on an identical virtual plane as illustrated in FIG. 8. With this configuration, similar to the heat L1 emitted from the heater 25 directly onto the inner circumferential surface of the metal thermal conductor 22 in a direction orthogonal to the inner circumferential surface of the metal thermal conductor 22, the heat L2 and the heat L3, which are emitted from the heater 25 directly onto the reflection face 24*a*1 of the first reflection plate 24*a* and the reflection face 24*b*1 of the second reflection plate 24*b* in a direction orthogonal to the reflection faces 24*a*1 and 24*b*1 and then reflected by them, travel to the inner circumferential surface of the metal thermal conductor 22 in a direction orthogonal to the inner circumferential surface of the metal thermal conductor 22.

Similar to the fixing device 20 according to the first illustrative embodiment depicted in FIGS. 5 and 6, the fixing device 20S according to the second illustrative embodiment can also control movement of the second reflection plates 24*b* according to the size, that is, the width of the recording medium P in the axial direction of the fixing belt 21, which passes through the nip NP. Alternatively, the fixing device 20S can control movement of the second reflection plates 24*b* based on the temperature differential of the fixing belt 21 between the temperatures detected by the first temperature sensor 40A and the second temperature sensor 40B depicted in FIG. 3.

As described above, similar to the fixing device 20 according to the first illustrative embodiment depicted in FIG. 5, in the fixing device 20S according to the second illustrative embodiment, with the reflector 24 extending in the axial direction of the fixing belt 21 to reflect heat emitted by the heater 25 thereto toward the inner circumferential surface of the metal thermal conductor 22, the reflection face 24*b*1 of each of the second reflection plates 24*b* disposed at the lateral end portions of the reflector 24 in the longitudinal direction thereof is rotated (e.g., tilted) toward the reflection face 24*a*1 of the first reflection plate 24*a* disposed at the center portion of the reflector 24 in the longitudinal direction thereof, thus shortening a warm-up time and a first print time of the fixing device 20S. Even when the fixing belt 21 of the fixing device 20S is rotated at high speed, the fixing belt 21 is heated to a desired fixing temperature quickly, preventing formation of a faulty toner image due to a low temperature of the fixing belt 21. Further, even when small recording media P are conveyed to the nip NP continuously, the non-conveyance regions N of the fixing belt 21 and the metal thermal conductor 22, through which the small recording media P do not pass, are not overheated.

Figure 10:
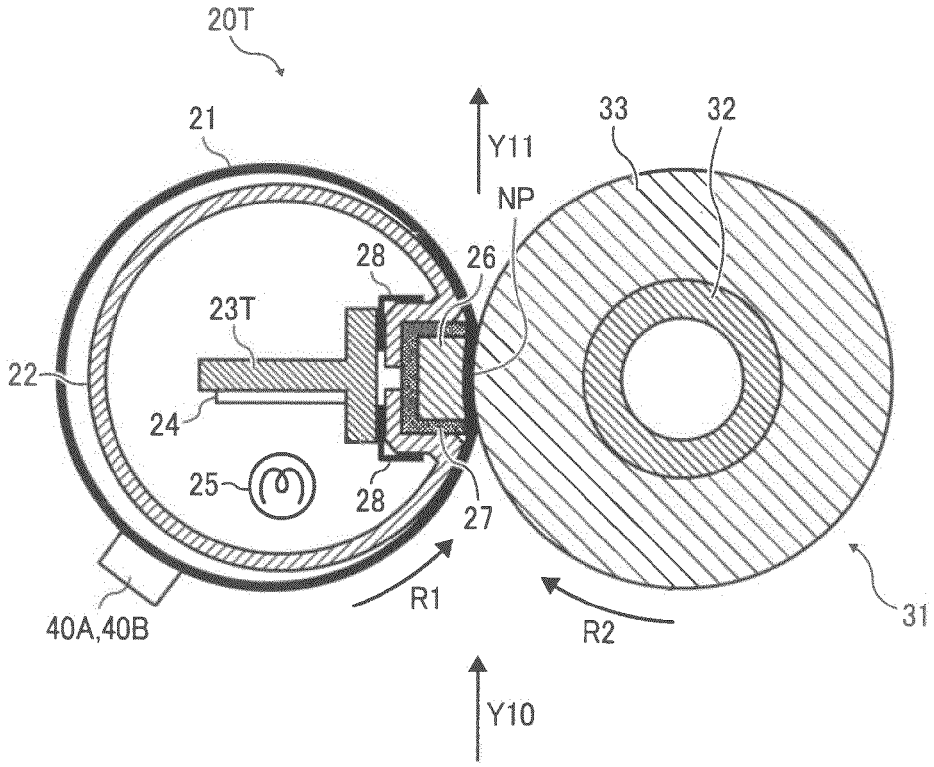
FIG. 10 is a vertical sectional view of a fixing device according to yet another exemplary embodiment of the present invention.

Referring to FIG. 10, the following describes a fixing device 20T, installed with a pad support 23T, according to a third illustrative embodiment of the present invention. FIG. 10 is a vertical sectional view of the fixing device 20T. As illustrated in FIG. 10, the pad support 23T employed in the fixing device 20T is different from the pad support 23 employed in the fixing device 20 depicted in FIG. 2 according to the first illustrative embodiment.

Similar to the fixing device 20 according to the first illustrative embodiment shown in FIG. 2, the fixing device 20T according to the third illustrative embodiment includes the fixing belt 21, the nip formation pad 26, the metal thermal conductor 22, the pad support 23T, the reflector 24, the heater 25, the pressing roller 31, the first temperature sensor 40A, the second temperature sensor 40B, the heat insulator 27, the stay 28, and the reflector moving assemblies 46 depicted in FIG. 5. For example, the reflector 24 includes the stationary, first reflection plate 24*a* and the movable, second reflection plates 24*b* that are rotated by the reflector moving assemblies 46, respectively. Alternatively, the fixing device 20T may employ the actuators 50 depicted in FIG. 8 instead of the reflector moving assemblies 46.

As illustrated in FIG. 10, the T-shaped pad support 23T of the fixing device 20T supports the nip formation pad 26 via the stay 28 and the metal thermal conductor 22 to reinforce the nip formation pad 26. The reflector 24 is attached to a face of the pad support 23T that faces the heater 25.

As described above, similar to the fixing device 20 according to the first illustrative embodiment depicted in FIG. 5 and the fixing device 20S according to the second illustrative embodiment depicted in FIG. 8, in the fixing device 20T according to the third illustrative embodiment, with the reflector 24 extending in the axial direction of the fixing belt 21 to reflect heat emitted by the heater 25 thereto toward the inner circumferential surface of the metal thermal conductor 22, the reflection face 24*b*1 of each of the second reflection plates 24*b* disposed at the lateral end portions of the reflector 24 in the longitudinal direction thereof is rotated (e.g., tilted) toward the reflection face 24*a*1 of the first reflection plate 24*a* disposed at the center portion of the reflector 24 in the longitudinal direction thereof, thus shortening a warm-up time and a first print time of the fixing device 20T. Even when the fixing belt 21 of the fixing device 20T is rotated at high speed, the fixing belt 21 is heated to a desired fixing temperature quickly, preventing formation of a faulty toner image due to a low temperature of the fixing belt 21. Further, even when small recording media P are conveyed to the nip NP continuously, the non-conveyance regions N of the fixing belt 21 and the metal thermal conductor 22, through which the small recording media P do not pass, are not overheated.

Figure 11:
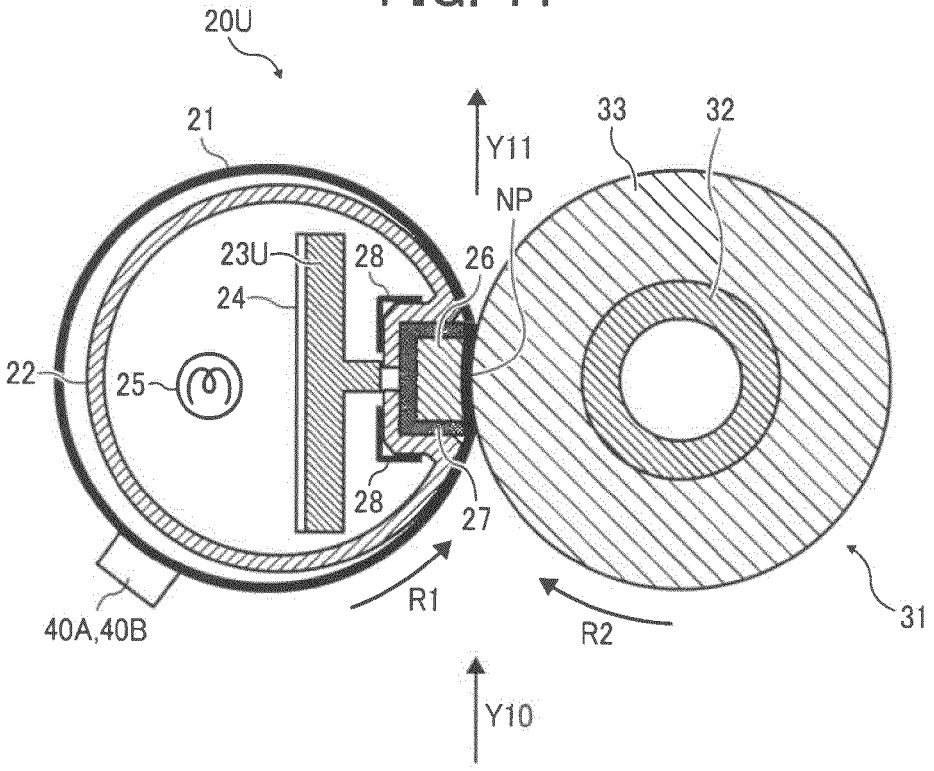
FIG. 11 is a vertical sectional view of a fixing device according to yet another exemplary embodiment of the present invention.

Referring to FIG. 11, the following describes a fixing device 20U, installed with a pad support 23U, according to a fourth illustrative embodiment of the present invention. FIG. 11 is a vertical sectional view of the fixing device 20U. As illustrated in FIG. 11, the pad support 23U employed in the fixing device 20U is different from the pad support 23 employed in the fixing device 20 depicted in FIG. 2 according to the first illustrative embodiment.

Similar to the fixing device 20 according to the first illustrative embodiment shown in FIG. 2, the fixing device 20U according to the fourth illustrative embodiment includes the fixing belt 21, the nip formation pad 26, the metal thermal conductor 22, the pad support 23U, the reflector 24, the heater 25, the pressing roller 31, the first temperature sensor 40A, the second temperature sensor 40B, the heat insulator 27, the stay 28, and the reflector moving assemblies 46 depicted in FIG. 5. For example, the reflector 24 includes the stationary, first reflection plate 24*a* and the movable, second reflection plates 24*b* that are rotated by the reflector moving assemblies 46, respectively. Alternatively, the fixing device 20U may employ the actuators 50 depicted in FIG. 8 instead of the reflector moving assemblies 46.

As illustrated in FIG. 11, the T-shaped pad support 23U of the fixing device 20U supports the nip formation pad 26 via the metal thermal conductor 22 and the heat insulator 27 to reinforce the nip formation pad 26. The pad support 23U vertically divides the interior of the substantially tubular metal thermal conductor 22 into two communicable compartments, a nip-side compartment facing the nip NP and a non-nip-side compartment disposed back-to-back to the nip-side compartment, thus defining a vertical border between the nip-side compartment and the non-nip-side compartment. The heater 25 is disposed in the larger, non-nip-side compartment. The reflector 24 is attached to a face of the pad support 23U that faces the heater 25.

As described above, similar to the fixing devices 20, 20S, and 20T according to the above-described exemplary embodiments depicted in FIGS. 5, 8, and 10, respectively, in the fixing device 20U according to the fourth illustrative embodiment, with the reflector 24 extending in the axial direction of the fixing belt 21 to reflect heat emitted by the heater 25 thereto toward the inner circumferential surface of the metal thermal conductor 22, the reflection face 24*b*1 of each of the second reflection plates 24*b* disposed at the lateral end portions of the reflector 24 in the longitudinal direction thereof is rotated (e.g., tilted) toward the reflection face 24*a*1 of the first reflection plate 24*a* disposed at the center portion of the reflector 24 in the longitudinal direction thereof, thus shortening a warm-up time and a first print time of the fixing device 20U. Even when the fixing belt 21 of the fixing device 20U is rotated at high speed, the fixing belt 21 is heated to a desired fixing temperature quickly, preventing formation of a faulty toner image due to a low temperature of the fixing belt 21. Further, even when small recording media P are conveyed to the nip NP continuously, the non-conveyance regions N of the fixing belt 21 and the metal thermal conductor 22, through which the small recording media P do not pass, are not overheated.

Figure 12:
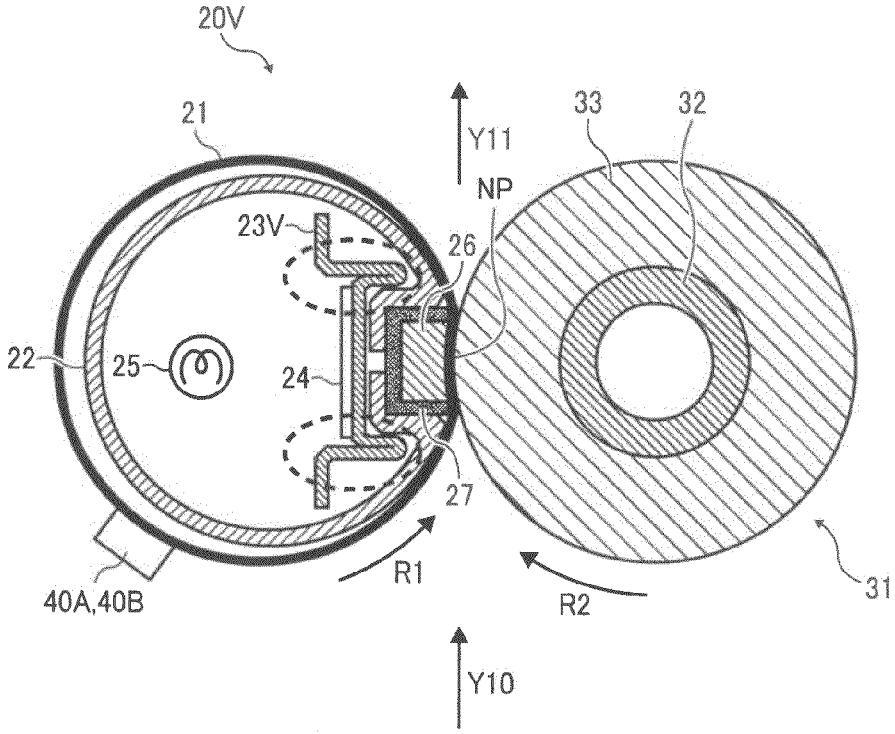
FIG. 12 is a vertical sectional view of a fixing device according to yet another exemplary embodiment of the present invention.

Referring to FIG. 12, the following describes a fixing device 20V, installed with a pad support 23V, according to a fifth illustrative embodiment of the present invention. FIG. 12 is a vertical sectional view of the fixing device 20V. As illustrated in FIG. 12, the pad support 23V employed in the fixing device 20V is different from the pad support 23 employed in the fixing device 20 depicted in FIG. 2 according to the first illustrative embodiment.

Similar to the fixing device 20 according to the first illustrative embodiment shown in FIG. 2, the fixing device 20V according to the fifth illustrative embodiment includes the fixing belt 21, the nip formation pad 26, the metal thermal conductor 22, the pad support 23V, the reflector 24, the heater 25, the pressing roller 31, the first temperature sensor 40A, the second temperature sensor 40B, the heat insulator 27, and the reflector moving assemblies 46 (depicted in FIG. 5). For example, the reflector 24 includes the stationary, first reflection plate 24*a* and the movable, second reflection plates 24*b* that are rotated by the reflector moving assemblies 46, respectively. Alternatively, the fixing device 20V may employ the actuators 50 depicted in FIG. 8 instead of the reflector moving assemblies 46.

As illustrated in FIG. 12, the flanged pad support 23V of the fixing device 20V supports the nip formation pad 26 via the metal thermal conductor 22 and the heat insulator 27 to reinforce the nip formation pad 26. Additionally, a part of the pad support 23V supports and maintains the concave shape of the metal thermal conductor 22 at the nip NP as the stay 28 depicted in FIG. 4 does. The pad support 23V vertically divides the interior of the substantially tubular metal thermal conductor 22 into two communicable compartments, a nip-side compartment facing the nip NP and a non-nip-side compartment disposed back-to-back to the nip-side compartment, thus defining a vertical border between the nip-side compartment and the non-nip-side compartment. The heater 25 is disposed in the larger, non-nip-side compartment. The reflector 24 is attached to a face of the pad support 23V that faces the heater 25.

With the configuration described above, the flanged pad support 23V makes the nip-side compartment, which does not receive heat from the heater 25 directly, smaller than the lower compartment inside the metal thermal conductor 22 defined by the pad support 23 shown in FIG. 2 and the pad support 23T shown in FIG. 10, in which the heater 25 is installed. Accordingly, the heater 25 of the fixing device 20V can heat the metal thermal conductor 22 uniformly in the circumferential direction thereof, facilitating uniform temperature distribution of the fixing belt 21 in the circumferential direction thereof and improving heating efficiency of the metal thermal conductor 22 for heating the fixing belt 21.

Further, in addition to providing the larger non-nip-side compartment installed with the heater 25, the flanged pad support 23V provides a strength against bending by pressure from the pressing roller 31 by having a certain length in a horizontal direction in FIG. 12, in each of the two regions indicated by the broken line in FIG. 12, in which the pressing roller 31 applies pressure to the nip formation pad 26.

As described above, similar to the fixing devices 20, 20S, 20T, and 20U according to the above-described exemplary embodiments depicted in FIGS. 5, 8, 10, and 11, respectively, in the fixing device 20V according to the fifth illustrative embodiment, with the reflector 24 extending in the axial direction of the fixing belt 21 to reflect heat emitted by the heater 25 thereto toward the inner circumferential surface of the metal thermal conductor 22, the reflection face 24*b*1 of each of the second reflection plates 24*b* disposed at the lateral end portions of the reflector 24 in the longitudinal direction thereof is rotated (e.g., tilted) toward the reflection face 24*a*1 of the first reflection plate 24*a* disposed at the center portion of the reflector 24 in the longitudinal direction thereof, thus shortening a warm-up time and a first print time of the fixing device 20V. Even when the fixing belt 21 of the fixing device 20V is rotated at high speed, the fixing belt 21 is heated to a desired fixing temperature quickly, preventing formation of a faulty toner image due to a low temperature of the fixing belt 21. Further, even when small recording media P are conveyed to the nip NP continuously, the non-conveyance regions N of the fixing belt 21 and the metal thermal conductor 22, through which the small recording media P do not pass, are not overheated.

Figure 13:
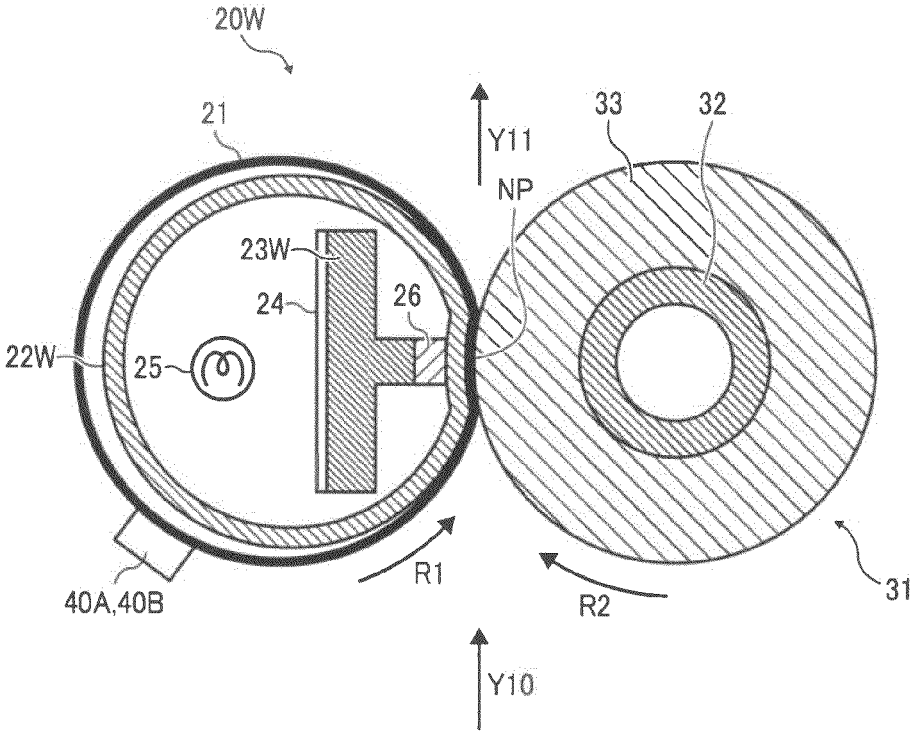
FIG. 13 is a vertical sectional view of a fixing device according to yet another exemplary embodiment of the present invention.

Referring to FIG. 13, the following describes a fixing device 20W, installed with a metal thermal conductor 22W and a pad support 23W, according to a sixth illustrative embodiment of the present invention. FIG. 13 is a vertical sectional view of the fixing device 20W. As illustrated in FIG. 13, the metal thermal conductor 22W and the pad support 23W employed in the fixing device 20W are different from the metal thermal conductor 22 and the pad support 23 employed in the fixing device 20 depicted in FIG. 2 according to the first illustrative embodiment.

Similar to the fixing device 20 according to the first illustrative embodiment shown in FIG. 2, the fixing device 20W according to the sixth illustrative embodiment includes the fixing belt 21, the nip formation pad 26, the metal thermal conductor 22W, the pad support 23W, the reflector 24, the heater 25, the pressing roller 31, the first temperature sensor 40A, the second temperature sensor 40B, and the reflector moving assemblies 46 (depicted in FIG. 5). For example, the reflector 24 includes the stationary, first reflection plate 24*a* and the movable, second reflection plates 24*b* that are rotated by the reflector moving assemblies 46, respectively. Alternatively, the fixing device 20W may employ the actuators 50 depicted in FIG. 8 instead of the reflector moving assemblies 46.

As illustrated in FIG. 13, similar to the pad support 23U of the fixing device 20U according to the fourth illustrative embodiment shown in FIG. 11, the pad support 23W of the fixing device 20W according to the sixth illustrative embodiment is also T-shaped to vertically divide the interior of the substantially tubular metal thermal conductor 22W into two communicable compartments, a nip-side compartment facing the nip NP and a non-nip-side compartment disposed back-to-back to the nip-side compartment, thus defining a vertical border between the nip-side compartment and the non-nip-side compartment.

Unlike the substantially tubular metal thermal conductor 22, having the concave portion facing the nip NP, employed in the fixing devices 20, 20S, 20T, 20U, and 20V depicted in FIGS. 2, 8, 10, 11, and 12, respectively, the metal thermal conductor 22W has a tubular shape that faces the fixing belt 21 over the entire inner circumferential surface of the fixing belt 21. Accordingly, the pad support 23W contacts the nip formation pad 26 to support it directly, and presses against the pressing roller 31 via the nip formation pad 26, the metal thermal conductor 22W, and the fixing belt 21. The heater 25 is disposed in the larger, non-nip-side compartment. The reflector 24 is attached to a face of the pad support 23W that faces the heater 25.

As described above, similar to the fixing devices 20, 20S, 20T, 20U, and 20V according to the above-described exemplary embodiments depicted in FIGS. 5, 8, 10, 11, and 12, respectively, in the fixing device 20W according to the sixth illustrative embodiment, with the reflector 24 extending in the axial direction of the fixing belt 21 to reflect heat emitted by the heater 25 thereto toward an inner circumferential surface of the metal thermal conductor 22W, the reflection face 24*b*1 of each of the second reflection plates 24*b* disposed at the lateral end portions of the reflector 24 in the longitudinal direction thereof is rotated (e.g., tilted) toward the reflection face 24*a*1 of the first reflection plate 24*a* disposed at the center portion of the reflector 24 in the longitudinal direction thereof, thus shortening a warm-up time and a first print time of the fixing device 20W. Even when the fixing belt 21 of the fixing device 20W is rotated at high speed, the fixing belt 21 is heated to a desired fixing temperature quickly, preventing formation of a faulty toner image due to a low temperature of the fixing belt 21. Further, even when small recording media P are conveyed to the nip NP continuously, the non-conveyance regions N of the fixing belt 21 and the metal thermal conductor 22W, through which the small recording media P do not pass, are not overheated.

In the fixing devices 20, 20S, 20T, 20U, 20V, and 20W according to the above-described exemplary embodiments, the fixing belt 21 constructed of multiple layers is used as a fixing rotary body. Alternatively, an endless fixing film made of polyimide, polyamide, fluorocarbon resin, and/or metal may be used as a fixing rotary body to provide effects equivalent to those provided by the fixing belt 21 as described above.

Further, the fixing devices 20, 20S, 20T, 20U, 20V, and 20W according to the above-described exemplary embodiments include the two second reflection plates 24*b* and the two reflector moving assemblies 46 that move the two second reflection plates 24*b*, respectively, because the recording medium P passing through the nip NP is centered in the axial direction of the fixing belt 21. Alternatively, the above-described exemplary embodiments may be applied to a fixing device in which the recording medium P conveyed through the nip NP is not centered but is aligned on one lateral edge of the fixing belt 21. In that case, the fixing device may include a single second reflection plate 24*b* and a single reflector moving assembly 46 provided at another lateral end of the fixing belt 21 opposite the lateral edge of the fixing belt 21 on which the recording medium P is aligned. In such fixing device also, the single reflector moving assembly 46 may tilt the single second reflection plate 24*b* toward the first reflection plate 24*a* according to the size of the recording medium P, providing the effects of the above-described exemplary embodiments.

According to the above-described exemplary embodiments, a state in which the nip formation pad, the metal thermal conductor, and the pad support are "fixedly disposed" inside the fixing rotary body defines a state in which they are disposed inside the fixing rotary body without being rotated. Therefore, even when a biasing member (e.g., a spring) biases the nip formation pad against the pressing rotary body via the fixing rotary body at the nip, for example, the nip formation pad is "fixedly disposed" inside the fixing rotary body as long as it is not rotated.

Further, according to the above-described exemplary embodiments, the "conveyance region" defines a region corresponding to the width of the recording medium passing through the nip formed between the fixing rotary body and the pressing rotary body of the fixing device in a width direction of the recording medium perpendicular to the conveyance direction of the recording medium. Conversely, the "non-conveyance region" defines a region outside the conveyance region.

Additionally, the "width direction" defines a direction perpendicular to the conveyance direction of the recording medium passing through the nip formed between the fixing rotary body and the pressing rotary body of the fixing device.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

a flexible, endless, belt-shaped fixing rotary body formed into a loop;

a pressing rotary body provided outside the loop formed by the fixing rotary body;

a nip formation pad provided inside the loop formed by the fixing rotary body and pressed against the pressing rotary body via the fixing rotary body to form a nip between the pressing rotary body and the fixing rotary body through which the recording medium bearing the toner image passes;

a substantially tubular, metal thermal conductor provided inside the loop formed by the fixing rotary body to heat the fixing rotary body;

a heater provided inside the metal thermal conductor to heat the metal thermal conductor;

a pad support provided inside the metal thermal conductor to support the nip formation pad;

a reflector provided between the heater and the pad support to reflect heat emitted by the heater thereto toward an inner circumferential surface of the metal thermal conductor, the reflector comprising:

a center reflection portion provided at a center of the reflector in a longitudinal direction thereof; and a plurality of end reflection portions provided at respective lateral ends of the reflector in the longitudinal direction thereof, outboard of the center reflection portion; and a plurality of reflector moving assemblies connected to the plurality of end reflection portions of the reflector, respectively, to tilt the plurality of end reflection portions with respect to the center reflection portion, wherein:

the reflector further comprises a plurality of rotation axes provided at respective lateral ends of the center reflection portion in the longitudinal direction of the reflector, the plurality of end reflection portions is plate-shaped and rotates about the rotation axes, respectively, the center reflection portion comprises a reflection face to reflect heat emitted by the heater thereto toward the metal thermal conductor, and each of the plurality of end reflection portions comprises a reflection face to reflect heat emitted by the heater thereto toward the metal thermal conductor and a non-reflection face disposed back-to-back to the reflection face, and each of the plurality of reflector moving assemblies comprises:

a cam roller to move in the longitudinal direction of the reflector and press against the non-reflection face of the end reflection portion so as to rotate the end reflection portion and tilt the reflection face of the end reflection portion toward the reflection face of the center reflection portion; and a biasing member mounted on the pad support and attached to the end reflection portion to bias the end reflection portion toward the pad support to align the reflection face of the end reflection portion with the reflection face of the center reflection portion.

2. The fixing device according to claim 1, wherein, depending on a width of the recording medium, the plurality of reflector moving assemblies tilts the respective end reflection portions connected thereto toward the center reflection portion.

3. The fixing device according to claim 1, further comprising:

a first temperature detector facing a center portion of the fixing rotary body in an axial direction thereof to detect a first temperature of the center portion of the fixing rotary body; and a second temperature detector facing one lateral end portion of the fixing rotary body in the axial direction thereof to detect a second temperature of the lateral end portion of the fixing rotary body, wherein, when the second temperature detected by the second temperature detector is greater than the first temperature detected by the first temperature detector by a predetermined value, the plurality of reflector moving assemblies tilts the respective end reflection portions toward the center reflection portion.

4. The fixing device according to claim 1, wherein the pad support is T-shaped in cross-section and divides the interior of the metal thermal conductor into two communicable compartments, and wherein the heater and the reflector are provided in a larger compartment of the two communicable compartments.

5. The fixing device according to claim 1, wherein the pad support is flanged and divides the interior of the metal thermal conductor into two communicable compartments, and wherein the heater and the reflector are provided in a larger compartment of the two communicable compartments.

6. The fixing device according to claim 1, wherein the reflector is attached to the pad support.

7. The fixing device according to claim 1, wherein the metal thermal conductor is disposed opposite an inner circumferential surface of the fixing rotary body other than the nip.

8. An image forming apparatus comprising the fixing device according to claim 1.

* * * * *